US009580202B2

(12) United States Patent
Pettersson

(10) Patent No.: US 9,580,202 B2
(45) Date of Patent: Feb. 28, 2017

(54) FOLDABLE BOX TEMPLATE BACKGROUND

(71) Applicant: Packsize LLC, Salt Lake City, UT (US)

(72) Inventor: Niklas Pettersson, Vasteras (SE)

(73) Assignee: Packsize LLC, Salt Lake City, UT (US)

( * ) Notice: Subject to any disclaimer, the term of this patent is extended or adjusted under 35 U.S.C. 154(b) by 0 days.

(21) Appl. No.: 14/370,725

(22) PCT Filed: Jan. 3, 2013

(86) PCT No.: PCT/US2013/020149

§ 371 (c)(1),
(2) Date: Jul. 3, 2014

(87) PCT Pub. No.: WO2013/103722

PCT Pub. Date: Jul. 11, 2013

(65) Prior Publication Data

US 2014/0367460 A1 Dec. 18, 2014

Related U.S. Application Data

(60) Provisional application No. 61/584,093, filed on Jan. 6, 2012, provisional application No. 61/597,896, filed on Feb. 13, 2012.

(51) Int. Cl.
*B65D 5/42* (2006.01)
*B31B 5/60* (2006.01)
(Continued)

(52) U.S. Cl.
CPC ..... *B65D 5/4279* (2013.01); *B31B 1/00* (2013.01); *B31B 3/26* (2013.01); *B31B 5/60* (2013.01);
(Continued)

(58) Field of Classification Search
CPC ..... B31B 3/26; B31B 5/60
(Continued)

(56) References Cited

U.S. PATENT DOCUMENTS 1,200,522 A 10/1916 Richardson
1,234,917 A 7/1917 McClay
(Continued)

FOREIGN PATENT DOCUMENTS

DE 29808803 7/1998
EP 0621194 10/1994
(Continued)

OTHER PUBLICATIONS

International Search Report and Written Opinion, United States Search Authority, Completed Feb. 12, 2013, Mailed Mar. 4, 2013.
(Continued)

*Primary Examiner* — Christopher Demeree
(74) *Attorney, Agent, or Firm* — Workman Nydegger

(57) ABSTRACT

A foldable box template includes first, second, third, fourth, and fifth segments. Each of the segments has a length, a width, and one or more flaps. The first segment is positioned at a first end of the template and the fifth segment is positioned at a second, opposing end of the template. The sum of the lengths of the first segment and the fifth segment is generally equal to the length of the third segment. As a result, the first and fifth segments form a seam on a sidewall of a box formed from the box template. In some cases, the seam formed by the first and fifth segments is offset from seams formed in top and bottom surfaces of the box. The seam formed by the first and fifth segments is offset from a corner of the box.

20 Claims, 17 Drawing Sheets

(51) Int. Cl.

| | |
|---|---|
| ***B31B 3/26*** | (2006.01) |
| ***B65D 5/02*** | (2006.01) |
| ***B31B 1/00*** | (2006.01) |

(52) U.S. Cl.

CPC .... *B65D 5/0236* (2013.01); *B31B 2201/6078* (2013.01); *B31B 2201/6086* (2013.01); *B31B 2203/066* (2013.01); *B31B 2203/082* (2013.01)

(58) Field of Classification Search

USPC ..... 493/121; 229/172, 181

See application file for complete search history.

(56) References Cited

U.S. PATENT DOCUMENTS

| | | | | |
|---|---|---|---|---|
| 1,703,042 | A | | 3/1923 | Kondolf |
| 1,722,422 | A | | 7/1928 | Johnson |
| 2,185,544 | A | | 8/1933 | Darragh |
| 1,996,965 | A | | 4/1935 | Keppler |
| 2,074,638 | A | | 3/1937 | Black |
| 2,077,694 | A | | 4/1937 | Hinton |
| 2,277,717 | A | | 3/1942 | Sackett |
| 2,295,141 | A | | 9/1942 | Van Wingen |
| 2,399,537 | A | | 5/1944 | Belden |
| 2,832,270 | A | | 2/1955 | Pierce, Jr. |
| 2,709,032 | A | | 5/1955 | Ritchie |
| 2,806,643 | A | | 9/1957 | Weiss |
| 2,857,090 | A | | 10/1958 | Fallert |
| 2,987,236 | A | * | 6/1961 | Strine ..... 229/176 |
| 3,003,676 | A | | 10/1961 | De Nola |
| 3,101,886 | A | | 8/1963 | Ring |
| 3,143,937 | A | | 8/1964 | Martin |
| 3,158,307 | A | | 11/1964 | Mayer |
| 3,162,351 | A | | 12/1964 | Rudofski |
| 3,184,136 | A | | 5/1965 | Forbes |
| 3,221,973 | A | | 12/1965 | Kalbrener |
| 3,237,841 | A | * | 3/1966 | Ridgeway, Jr. ..... 229/122 |
| 3,268,147 | A | | 8/1966 | Burger |
| 3,441,194 | A | | 4/1969 | Kistner |
| 3,443,684 | A | | 5/1969 | Taylor |
| 3,482,759 | A | | 12/1969 | Ortiz |
| 3,586,233 | A | | 6/1971 | McCulloch |
| 3,690,222 | A | | 9/1972 | Schroeder |
| 3,804,321 | A | | 4/1974 | Forbes |
| 3,832,826 | A | | 9/1974 | Ullman |
| 3,843,038 | A | | 10/1974 | Sax |
| 3,923,234 | A | | 12/1975 | Lund |
| 3,948,152 | A | | 4/1976 | Nolan |
| 3,957,196 | A | | 5/1976 | Kellerman |
| 4,027,817 | A | | 6/1977 | Fremion |
| 4,094,451 | A | | 6/1978 | Wescoat |
| RE30,325 | E | | 7/1980 | Waldbauer |
| 4,211,356 | A | | 7/1980 | Tsuchiya |
| 4,215,522 | A | | 8/1980 | Clift |
| 4,264,200 | A | | 4/1981 | Tickner |
| 4,326,633 | A | | 4/1982 | Schillinger |
| 4,399,915 | A | | 8/1983 | Sorenson |
| 4,522,016 | A | | 6/1985 | Dirico |
| 4,608,038 | A | | 8/1986 | Virta |
| 4,838,468 | A | | 6/1989 | Lesse |
| 4,972,954 | A | | 11/1990 | Dickie |
| 5,058,872 | A | | 10/1991 | Gladow |
| 5,115,625 | A | | 5/1992 | Barbulesco |
| 5,372,259 | A | | 12/1994 | Suzuki |
| 5,374,326 | A | | 12/1994 | Marchetti |
| 5,465,900 | A | | 11/1995 | Baratto et al. |
| 5,501,339 | A | | 3/1996 | Suzuki |
| 5,823,352 | A | | 10/1998 | Mena |
| 5,836,498 | A | | 11/1998 | Turek |
| 5,878,947 | A | * | 3/1999 | Hoy et al. ..... 229/122.1 |
| 5,975,303 | A | | 11/1999 | Morell |
| 5,996,885 | A | | 12/1999 | Chu |
| 6,012,587 | A | | 1/2000 | McCullough |
| 6,016,904 | A | | 1/2000 | Hammock |
| 6,105,854 | A | * | 8/2000 | Spivey et al. ..... 229/122.1 |
| 6,471,124 | B1 | | 10/2002 | Tedeschi |
| 6,675,970 | B1 | | 1/2004 | Nemoto |
| 7,100,811 | B2 | | 9/2006 | Pettersson |
| 7,121,453 | B2 | | 10/2006 | Nass |
| 7,565,998 | B2 | | 7/2009 | McClure |
| 7,726,489 | B2 | | 6/2010 | Li |
| 7,913,896 | B2 | | 3/2011 | Reinkensmeyer |
| 8,256,620 | B2 | | 9/2012 | Kiessner |
| 8,584,928 | B2 | | 11/2013 | Keissner |
| 2002/0011171 | A1 | | 1/2002 | Usui |
| 2004/0200890 | A1 | | 10/2004 | Mesly |
| 2005/0121356 | A1 | | 6/2005 | Wisecarver |
| 2005/0211600 | A1 | | 9/2005 | Saito |
| 2007/0145664 | A1 | | 6/2007 | Sardella |
| 2007/0199648 | A1 | | 8/2007 | Hulverscheidt |
| 2011/0272312 | A1 | | 11/2011 | Kramer |

FOREIGN PATENT DOCUMENTS

| | | |
|---|---|---|
| EP | 732269 | 9/1996 |
| EP | 1211192 | 6/2002 |
| EP | 1801020 | 6/2007 |
| EP | 1870341 | 12/2007 |
| FR | 2813584 | 3/2002 |
| GB | 695780 | 8/1953 |
| GB | 2079802 | 1/1982 |
| JP | 11-157569 | 6/1999 |
| JP | 2015503495 | 2/2015 |
| KR | 20-0251839 | 11/2001 |
| WO | 2006122539 | 11/2006 |
| WO | 2010022042 | 2/2010 |
| WO | 2011075445 | 6/2011 |
| WO | 2011081985 | 7/2011 |
| WO | 2013103722 | 7/2013 |

OTHER PUBLICATIONS

Custom Packaging Options, Inc. "Custom Corrugated Cardboard Boxes", http://packaging.got-boxes.com/category/custom-corrugated-cardboard-Boxes-3.

eHow.com "How to Make Custom Cardboard Box Sizes", http://www.ehow.com/how_5656898_make-custom-cardboard-box-Sizes.html, date unknown.

Instructables, "Build a Cardboard Box", http://www.instructables.com/id/Build-A-Cardboard-Box/, available at least as early as Jan. 1, 2008.

Ponoko, "Large Cardboard Box—No Glue", http://www.ponoko.com/design-your-own/products/large-cardboard-box-no-glue-6102, Jul. 20, 2011.

WebIndia123 "Box Making—Square Shaped Box", http://www.webindia123.com/craft/asp/craft.asp?c_id=166, Copyright 2000.

European Search Report for EP07011427 dated Oct. 12, 2007.

European Search Report for EP09808706 dated Feb. 16, 2012.

European Search Report for EP10841555 dated Sep. 18, 2014.

International Search Report and Written Opinion for PCT/US2009/049602 dated Aug. 25, 2009.

International Search Report and Written Opinion for PCT/US2009/054147 dated Mar. 17, 2010.

International Search Report and Written Opinion for PCT/US2009/065552 dated Jan. 21, 2010.

International Search Report and Written Opinion for PCT/US2009/064477 dated Dec. 29, 2009.

International Search Report and Written Opinion for PCT/US2010/022983 dated Apr. 13, 2010.

International Search Report and Written Opinion for PCT/US2010/031017 dated Jun. 28, 2010.

International Search Report and Written Opinion for PCT/US2010/60974 dated Feb. 17, 2011.

International Search Report and Written Opinion for PCT/US2013/020149 dated Mar. 4, 2013.

International Search Report and Written Opinion from PCT/US2009/065552 dated Jan. 21, 2010.

International Search Report and Written Opinion from PCT/US2009/064477 dated Dec. 29, 2009.

(56) References Cited

OTHER PUBLICATIONS

International Search Report and Written Opinion from PCT/US2010/022983 dated Apr. 13, 2010.
International Search Report from PCT/US2009/064248 dated Dec. 29, 2009.
International Search Report for PCT/DE2006/000863 dated Aug. 31, 2006.
U.S. Appl. No. 11/942,355, Sep. 10, 2010, Notice of Allowance.
U.S. Appl. No. 11/942,355, Jun. 17, 2009, Office Action.
U.S. Appl. No. 11/942,355, Mar. 16, 2010, Office Action.
U.S. Appl. No. 11/942,355, Nov. 30, 2010, Notice of Allowance.
U.S. Appl. No. 12/648,211, Dec. 1, 2011, Office Action.
U.S. Appl. No. 12/648,211, May 2, 2012, Notice of Allowance.
U.S. Appl. No. 12/648,211, May 23, 2012, Notice of Allowance.
U.S. Appl. No. 13/059,630, Mar. 29, 2013, Office Action.
U.S. Appl. No. 13/059,630, Jul. 19, 2013, Notice of Allowance.
European Search Report for EP13733829 dated May 18, 2015.
European Search Report for EP16178728.8 dated Dec. 2, 2016.

* cited by examiner

FOLDABLE BOX TEMPLATE BACKGROUND

CROSS-REFERENCE TO RELATED APPLICATIONS

This application claims priority to and the benefit of PCT Application No. PCT/US2013/020149, filed Jan. 3, 2013, entitled "FOLDABLE BOX TEMPLATE BACKGROUND", which claims the benefit of and priority to the following applications: U.S. Provisional Application No. 61/584,093, filed Jan. 6, 2012, entitled "FOLDABLE BOX TEMPLATE", and U.S. Provisional Application No. 61/597,896, filed Feb. 13, 2012, entitled "FOLDABLE BOX TEMPLATE". All of the aforementioned applications are incorporated by reference herein in their entirety.

BACKGROUND

1. The Technical Field

Exemplary embodiments of the invention relate to packaging. More specifically, embodiments of the invention relate to packaging templates that may be assembled into a box without requiring the packaging template to be glued together.

2. The Relevant Technology

In many industries, packaging materials are used to deliver products to clients. Often such packaging materials take the form of boxes which the products are place in for delivery. Such boxes may, of course, be of virtually any size and configuration. It may be that the product is placed directly inside the box without any additional protection. In other cases there may be some additional protection or cushioning provided. For instance, foam peanuts, bags of air, bubble-wrap, and the like may be used to protect a fragile or other product.

When an item is placed directly inside of a box, care is often taken to select a box that has dimensions that generally correspond to the dimensions of the item being boxed so that the item fits snugly within the box. Such may be desirable to prevent excess movement of the item and, consequently, reduce the shaking or movement of the item therein. The dimensions of standard sized boxes, however, often do not correspond to the size of the items being packaged therein. As a result, the items being packaged routinely do not snugly fit in standard sized boxes. To avoid excessive movement of the packaged items in such cases, additional cushioning is often placed in the box around the item.

Packaging items in boxes that are too large or that require additional cushioning is costly and inefficient. For instance, the additional material used in creating the larger packages and in cushioning items packaged therein increases the cost of packaging the items. Furthermore, storing a large assortment of premade boxes can require significant amounts of storage space that could otherwise be eliminated or more efficiently used. Moreover, packages that are too large for a particular item are more expensive to ship. Shipping prices are often affected by the size of the shipped package, and not just the package. Thus, reducing the size of an item's package can reduce the price of shipping the item.

To avoid such costs and inefficiencies, systems have been developed for creating custom sized boxes. Such systems create templates out of a planar material which may be folded to form boxes. The templates include sections that, when folded, form the sidewalls of the box. The templates also include flaps that, when folded, form the tops and bottoms of the boxes.

Prior to assembling such a template into a box, opposing sidewall sections are attached together to hold the template in a generally rectangularly shaped tube. The opposing sidewall sections are attached to one another via a glue tab. The glue tab is often integrally formed with and extends from one of the sidewall sections. Glue is applied to the glue tab and/or the opposing side wall section and the glue tab is secured to the opposing sidewall section. The glue is then allowed to set, after which the template may be arranged into a box shape, filled, and shipped.

Although the above-described custom sized boxes may reduce the costs and inefficiencies associated with using standard sized boxes, there are still some inefficiencies associated with these custom sized boxes. For instance, glue and glue applicators must be purchased and stored. Additionally, the glue must be given time to cure before assembling the template into a box.

Accordingly, it would be advantageous to have a box template that may be assembled into a box relatively quickly and which is custom sized to fit the item being packaged.

BRIEF SUMMARY OF THE INVENTION

This disclosure relates to foldable templates and methods for making custom sized boxes therefrom. More specifically, the disclosure relates to foldable box templates that do not require gluing during assembly and which may be custom sized according to a particular need.

In one embodiment, a foldable template for forming a box includes first, second, third, fourth, and fifth segments. Each of the segments has a substantially rectangular shape, a length, a width, and a plurality of flaps. The first segment and the fifth segment are disposed on opposing sides of the foldable template. The sum of the lengths of the first segment and the fifth segment are equal to the length of the third segment. In some embodiments, the length of the first segment is different than the length of the fifth segment, while in other embodiments the length of the first segment is generally equal to the length of the fifth segment.

In another embodiment, a foldable box includes a top surface and a bottom surface, each of which is formed by two opposing flaps. The two opposing flaps of the top surface form a seam and the two opposing flaps of the bottom surface form a seam. The seams of the top and bottom surfaces may be generally aligned with one another. The foldable box also includes four side surfaces extending between the top and bottom surfaces. One of the side surfaces is formed by two segments. The two segments of the side surface form a seam that is offset from a corner of the box. The seam of the side surface may also be either offset from or aligned with the seams of the top and bottom surfaces.

Yet another embodiment includes a method for making a box. The method includes providing a foldable box template that includes five segments. Each segment has a length, a width, and one or more flaps. Two of the segments (e.g., end segments) are disposed on opposite ends of the foldable box template. The sum of the lengths of the two opposing end segments is equal to the length of a middle segment. The method further includes folding the box template to form a top surface with two of the flaps, the two flaps defining a seam. Further, the method includes folding the box template to form a bottom surface with another two of the flaps. The two flaps that form the bottom surface also define a seam. Still further, the method includes folding the foldable box template to form four sidewalls. One of the sidewalls is formed by the two end segments. The two end segments that form the side surface define a seam that is offset from a corner of the box. The seam of the side surface may be offset from or aligned with the seams of the top and surface surfaces.

In yet a further embodiment, a foldable template for forming a box includes a plurality of identifiable sections that are arranged in first, second, third, fourth, and fifth columns and first, second, and third rows. Each column has a length and each row has a width. The first column, which is disposed at a first end of the template, includes a top flap in the first row, a center section in the second row, and a bottom flap in the third row. The second column includes a top flap in the first row, a center section in the second row, and a bottom flap in the third row. The third column includes a top flap in the first row, a center section in the second row, and a bottom flap in the third row. The fourth column includes a top flap in the first row, a center section in the second row, and a bottom flap in the third row. The fifth column, which is disposed at a second end of the template, includes a top flap in the first row, a center section in the second row, and a bottom flap in the third row. The length of third column is substantially equal to the sum of the lengths of the first and fifth columns.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
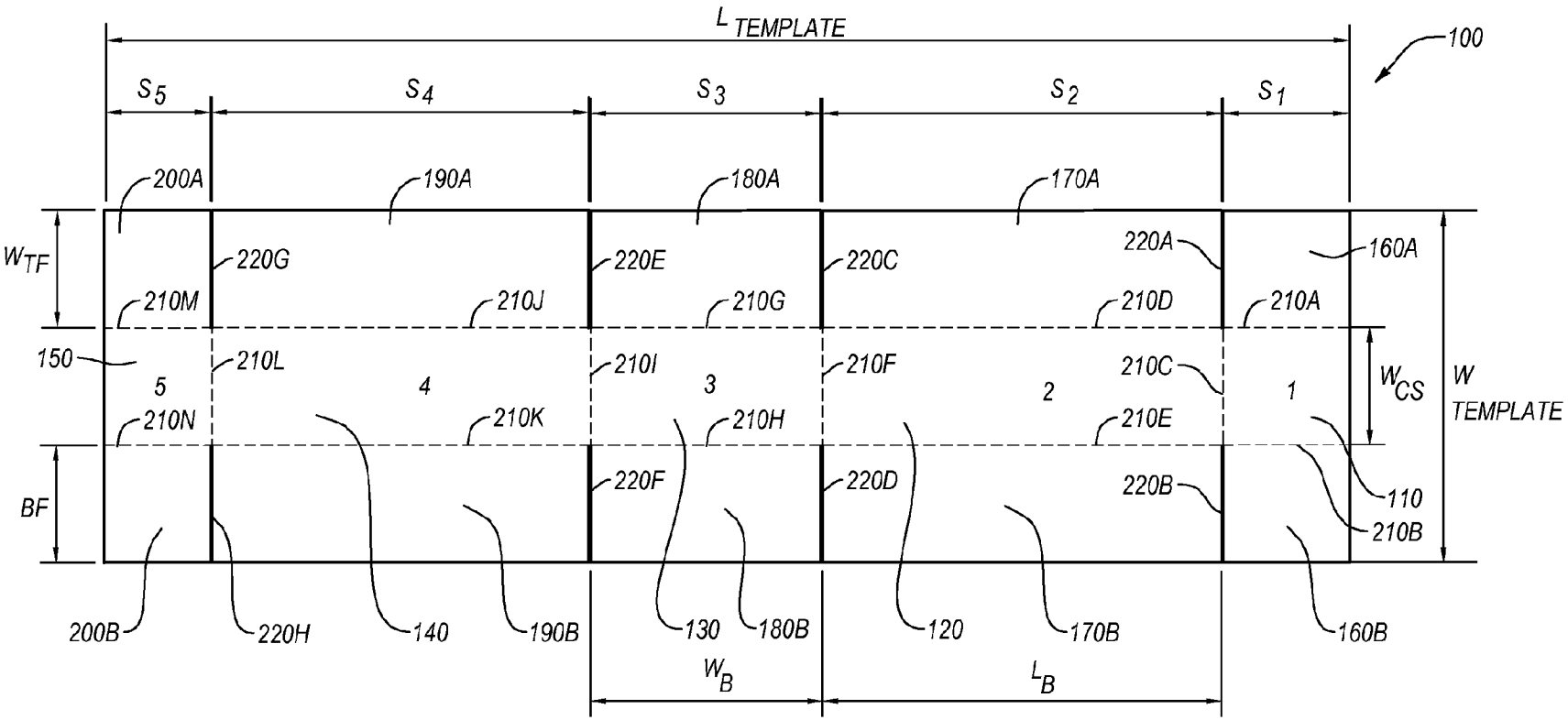
FIG. 1 illustrates a foldable box template according to an exemplary embodiment of the present invention.

The embodiments described herein generally relate to a foldable box template that may be arranged into a foldable box without requiring any part of the box template to be glued to any other part of the box template.

As used herein, the term "template" shall refer to a flat stock of material that can be folded into a box. A template may have cuts, notches, cutouts, divides, and/or creases that allow the template to be bent and/or folded into a box. Additionally, a template may be made from any suitable material, generally known to those skilled in the art. For example, cardboard or corrugated paperboard may be used as the template material. Such template materials may have any suitable thickness and weight to permit the template to be bent and/or folded into a box.

As used herein, the term "crease" shall refer to a line along which any portion of the template may be folded. For example, a crease may be an indentation in the template material, which may facilitate the folding of a portion of the template that is adjacent to the crease. A suitable indentation may be created by applying sufficient pressure to reduce the thickness of the material in the desired location and/or by removing some of the material along the desired location, such as by scoring.

The terms "notch," "cutout," and "cut" are used interchangeably herein and shall refer to a shape made by removing material from the template or by separating portions of the template material, such that an incision is made through the template.

While the present disclosure will be described in detail with reference to specific configurations, the descriptions are illustrative and are not to be construed as limiting the disclosure. Various modifications can be made to the illustrated configurations without departing from the spirit and scope of the invention as defined by the claims. For better understanding, like components have been designated by like reference numbers throughout the various accompanying figures.

All creases are identified on the figures with broken lines, and all notches or cuts are identified with bold/solid lines. Although specific creases and specific notches are identified with element numbers 210A-210N and 220A-220H, respectively, when a reference is made to a crease or a notch generally, such crease or a notch is identified with respective element number 210 or 220. Additionally, some flaps are designated as "top" flaps and are identified with a letter "A" following the flap element number; other flaps are designated as "bottom" flaps and are identified with a letter "B" following the flap element number. The "top" and "bottom" designations are arbitrary and made for descriptive purposes only. Accordingly, a described "top flap" may be considered a "bottom flap," a "top surface" may be considered a "bottom surface" or a side surface, and vice versa. Similarly, the terms "length," "width," and "height" are chosen arbitrarily. Thus, a described "length" may be considered a width or a height, a described "width" may be considered a length or a height, and a described "height" may be considered a length or a width. Such designations are not intended to represent or connote any specific orientation or location of the box template, its components, or a box formed therewith.

FIG. 1 illustrates an exemplary embodiment of a foldable box template 100. The foldable box template 100 may have a substantially rectangular shape and may comprise five segments. A first segment 1 includes a first center section 110, opposing top and bottom flaps 160A, 160B, and is defined in part by a length $S_1$. A second segment 2 includes a second center section 120, opposing top and bottom flaps 170A, 170B, and is defined in part by a length $S_2$. A third segment 3 includes a third center section 130, opposing top and bottom flaps 180A, 180B, and is defined in part by a length $S_3$. A fourth segment 4 includes a fourth center section 140, opposing top and bottom flaps 190A, 190B, and is defined in part by a length $S_4$. A fifth segment 5 includes a fifth center section 150, opposing top and bottom flaps 200A, 200B, and is defined in part by a length $S_5$. The sum of the lengths $S_1$, $S_2$, $S_3$, $S_4$, and $S_5$ may be equal to the length of the template $L_{template}$.

Each of segments 1-5 is defined by a width, which is the sum of the widths of the top flaps $W_{TF}$, the bottom flaps $W_{BF}$, and the center sections $W_{CS}$ for each respective segment. For instance, the width of segment 1 is the sum of the widths of center section 110, top flap 160A, and bottom flap 160B. In the illustrated embodiment, the widths of each of the segments 1-5 are substantially equal to one another and to the width of the template $W_{template}$. In other embodiments, however, some segments may have widths greater or less than the widths of other segments and/or the width of the template $W_{template}$. For instance, the width of one segment may be wider or narrower than another segment as a result of having wider or narrower top and/or bottom flaps.

Each center section and/or opposing flaps of a segment may have substantially rectangular shapes and may be defined by one or more creases, cuts, and/or edges of the foldable box template 100. The center sections may be defined by creases 210 and, for the center sections 110 and 150, which are disposed on opposing ends of the foldable box template 100, by an edge of the foldable box template 100. The flaps may be defined by creases 210, cuts 220, and one or more edges of the foldable box template 100. The creases 210 and cuts 220 may facilitate the folding of adjacent sections relative to one another in order to form a box from box template 100.

More specifically, center section 110 of first segment 1 is defined by creases 210A, 210B, 210C, and an edge of box template 100. Crease 210A separates center section 110 from top flap 160A, crease 210B separates center section 110 from bottom flap 160B, and crease 210C separates center section 110 from center section 120 of second segment 2. Cut 220A separates top flap 160A from top flap 170A of segment 2 and cut 220B separates bottom flap 160B from bottom flap 170B of segment 2.

Center section 120 of second segment 2 is defined by creases 210C, 210D, 210E, and 210F. As noted, crease 210C separates center section 120 from center section 110 of segment 1. Additionally, crease 210D separates center section 120 from top flap 170A, crease 210E separates center section 120 from bottom flap 170B, and crease 210F separates center section 120 from center section 130 of third segment 3. As noted, cuts 220A, 220B separate top and bottom flaps 170A, 170B, respectively, from top and bottom flaps 160A, 160B of segment 1. Further, cut 220C separates top flap 170A from top flap 180A of segment 3 and cut 220D separates bottom flap 170B from bottom flap 180B of segment 3.

Center section 130 of third segment 3 is defined by creases 210F, 210G, 210H, and 210I. As noted, crease 210F separates center section 130 from center section 120 of segment 2. Additionally, crease 210G separates center section 130 from top flap 180A, crease 210H separates center section 130 from bottom flap 180B, and crease 210I separates center section 130 from center section 140 of fourth segment 4. As noted, cuts 220C, 220D separate top and bottom flaps 180A, 180B, respectively, from top and bottom flaps 170A, 170B of segment 2. Further, cuts 220E, 220F separate top and bottom flaps 180A, 180B, respectively, from top and bottom flaps 190A, 190B of segment 4.

Center section 140 of fourth segment 4 is defined by creases 210I, 210J, 210K, and 210L. As noted, crease 210I separates center section 140 from center section 130 of segment 3. Additionally, crease 210J separates center section 140 from top flap 190A, crease 210K separates center section 140 from bottom flap 190B, and crease 210L separates center section 140 from center section 150 of fifth segment 5. As noted, cuts 220E, 220F separate top and bottom flaps 190A, 190B, respectively, from top and bottom flaps 180A, 180B of segment 3. Further, cuts 220G, 220H separate top and bottom flaps 190A, 190B, respectively, from top and bottom flaps 200A, 200B of segment 5.

Finally, center section 150 of fifth segment 5 is defined by creases 210L, 210M, 210N, and an edge of box template 100. As noted, crease 210L separates center section 150 from center section 140 of segment 4. Additionally, crease 210M separates center section 150 from top flap 200A and crease 210N separates center section 150 from bottom flap 200B.

As shown in FIG. 1, the first segment 1 and the fifth segment 5 are disposed at opposite ends of the foldable box template 100. The third segment 3 is disposed in the middle of foldable box template 100. The second segment 2 is disposed between the first segment 1 and the third segment 3. The fourth segment 4 is disposed between the third segment 3 and the fifth segment 5.

Following is a brief discussion of various dimensional relationships between segments 1-5. Although specific relationships will be discussed, it will be understood that these relationships are merely exemplary, and that foldable box templates according to the present invention may have dimensional relationships that are different than the exemplary relationships described below.

In some implementations, including the embodiment illustrated in FIG. 1, box template 100 may be folded to form a generally rectangular box in which the opposing sides of the box have dimensions that are generally equal to one another. For instance, when box template 100 is folded into a box, center sections 120 and 140 form opposing side surfaces of the box. In order for the resulting box to be generally rectangular in shape, center sections 120 and 140 may be formed with similar or identical dimensions. By way of example, the length $S_2$ (e.g., the length of segment 2) may be generally equal to the length $S_4$ (e.g., the length of segment 4). Accordingly, forming segments 2 and 4 with lengths $S_2$ and $S_4$ that are generally equal to one another allows for the resulting box to have a generally uniform length. In other words, lengths $S_2$ and $S_4$ may be generally equal to one another and may be the length $L_B$ of a box formed from box template 100. Nevertheless, in other implementations, lengths $S_2$ and $S_4$ may be different from one another.

Like center sections 120, 140, and as will be discussed in greater detail below, center section 130 of segment 3 may form a sidewall of a box formed from box template 100. The length $S_3$ of segment 3 may be equal to the width $W_B$ of the box formed from box template 100. As also discussed in greater detail below, the sidewall opposite the sidewall formed by center section 130 may be formed by center sections 110 and 150. In some implementations, the sum of the lengths $S_1$ and $S_5$ (e.g., the lengths of segments 1 and 5) may be generally equal to the length $S_3$. For instance, the lengths $S_1$ and $S_5$ may be generally equal to one another, and each of the lengths $S_1$ and $S_5$ may be equal to about half of the length $S_3$. In other implementations, one of the lengths $S_1$ and $S_5$ may be greater or less than the other length, but the sum of the lengths $S_1$ and $S_5$ may still be generally equal to the length $S_3$. For instance, in some implementations, the length of the center section 110 may be greater or less than the length of the center section 150 while the combine lengths of the center sections 110, 150 are generally equal to the length $S_3$. In still other implementations, the sum of the lengths $S_1$ and $S_5$ may be greater than the length $S_3$.

Depending on the shape of the desired box, the length $S_3$ may be equal to, greater than, or less than lengths $S_2$, $S_4$. Consequently, the length of the center section 130 may be equal to, greater than, or less than the length of either center section 120 or center section 140.

Figure 2:
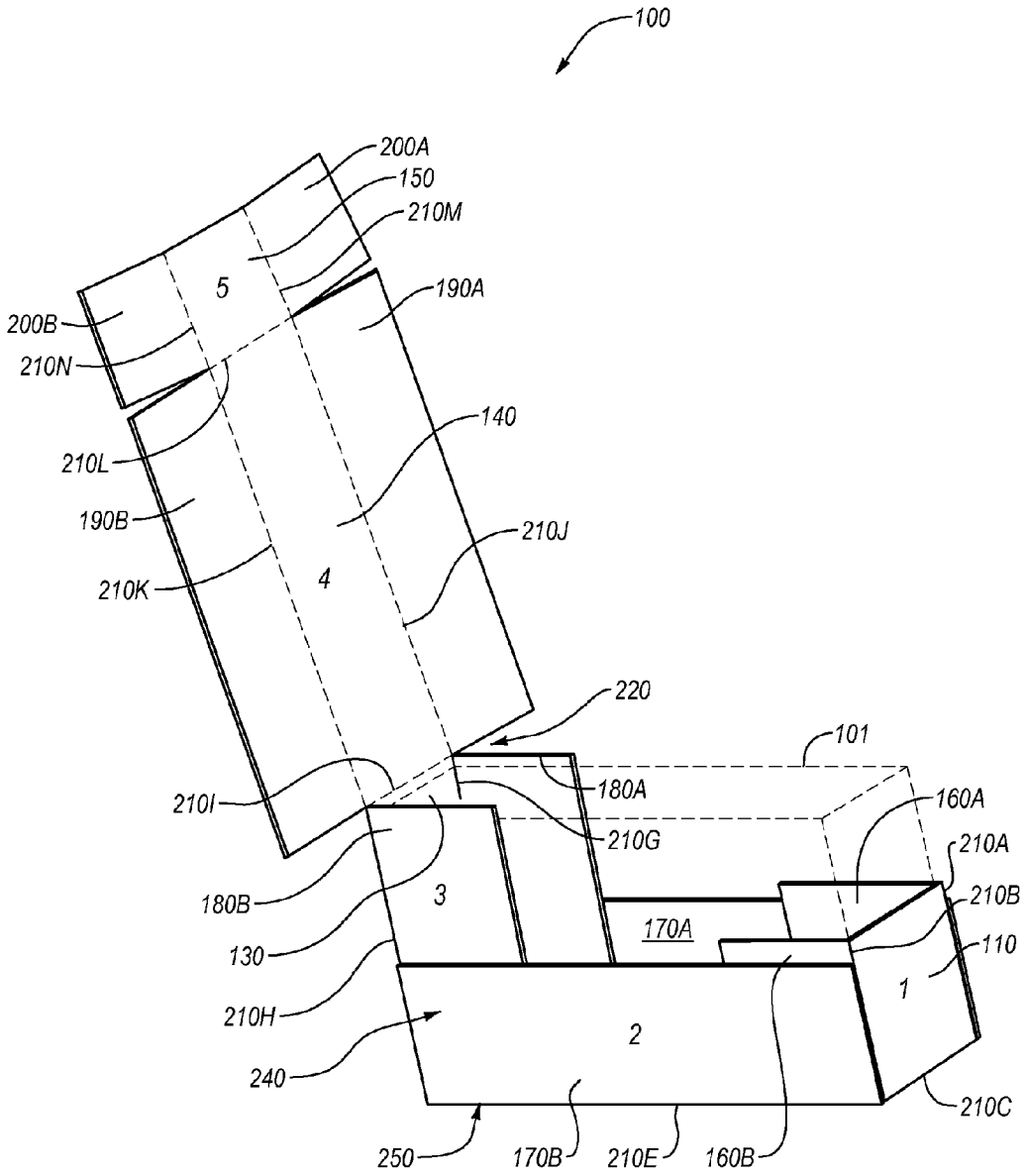
FIG. 2 illustrates the foldable box template of FIG. 1 partially folded into a box according to one exemplary method for constructing a box using the foldable box template of FIG. 1.
Figure 3:
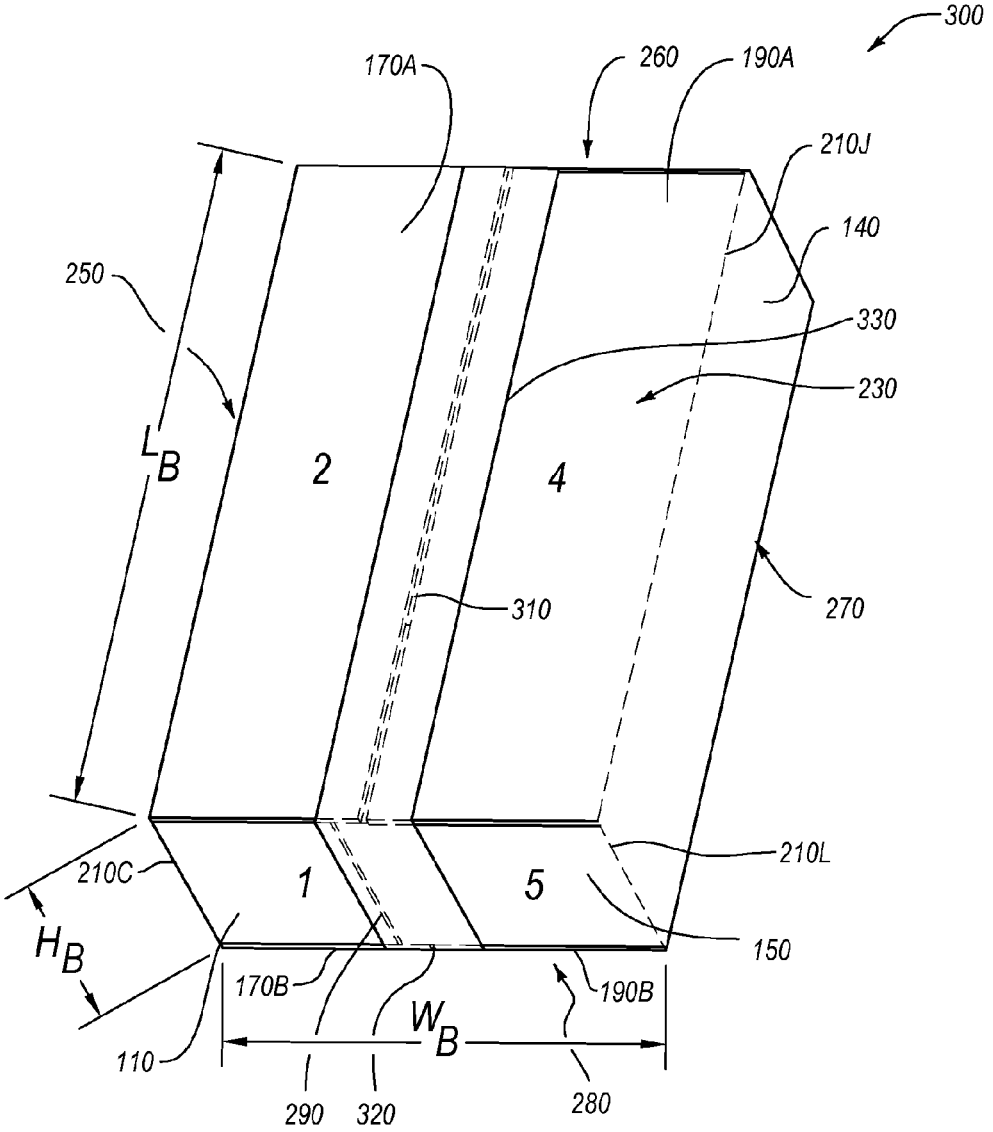
FIG. 3 illustrates a completely folded box constructed from the foldable box template illustrated in FIG. 1.

As noted above, the various flaps and center sections of the foldable box template 100 may be folded along the creases in order to construct a box. FIG. 2 illustrates the foldable box template 100 with some of the center sections and flaps folded according to one exemplary method of constructing a box using the foldable box template 100. FIG. 3 illustrates a completely folded box 300, which may be made from the foldable box template 100, as described below. In connection with FIGS. 2 and 3, the following description provides one exemplary method or sequence of steps for constructing a box 300 from the box template 100. It will be understood that the follow description is an exemplary method for constructing a box using box template 100 and is not intended to limit the disclosure. Other methods may be used to create box using template 100 without departing from the spirit of this disclosure.

In describing the process of forming box 300 from box template 100, the designations "top surface," "bottom surface," and "sidewalls" are used only for descriptive purposes. Thus, as noted elsewhere herein, a described "sidewall" may be considered a top or bottom surface, a described "top surface" may be considered a bottom surface or a sidewall, and a described "bottom surface" may be considered a top surface or a sidewall.

When forming a box 300 from box template 100 according to the present method, an item 101 may be placed on top of box template 100 and box template 100 may be folded around the item 101. In the embodiment illustrated in FIG. 2, for example, the item 101 may be placed on top of center section 120 and the remainder of box template 100 may be folded around the item 101 as described below.

The first section 1 may be folded along crease 210C so that center section 110 is positioned against or adjacent to a surface of the item 101, as shown in FIG. 2. Top and bottom flaps 160A, 160B may be folded along creases 210A, 210B, respectively, so as to be positioned against or adjacent to opposing surfaces of the item 101, as also shown in FIG. 2. When so folded, center section 110 may be oriented generally perpendicular to center section 120, and top and bottom flaps 160A, 160B may be oriented generally parallel to one another and generally perpendicular to both center section 110 and center section 120.

Top and bottom flaps 170A, 170B may then be folded along creases 210D, 210E, respectively, to at least partially cover top and bottom flaps 160A, 160B and portions of the item 101. The folded top flap 170A may form a portion of a top surface 230, and the folded bottom flap 170B may form a portion of a bottom surface 240. The center section 120 may form a first sidewall 250 of the foldable box 300.

The top and bottom flaps 180A, 180B of section 3 may then be folded along the creases 210G, 210H, respectively, and substantially perpendicular to the center section 130. Center section 130 may then be folded along crease 210F until center section 130 is positioned against or adjacent to a surface of the item 101, as shown in FIG. 2. When center section 130 is so positioned, center section 130 may be generally perpendicular to center section 120. In this position, center section 130 may form a second sidewall 260 of the foldable box 300.

As center section 130 is folded along crease 210F, top flap 180A may be positioned between the item 101 and top flap 170A, and bottom flap 180B may be positioned between the item 101 and bottom flap 170B, as shown in FIG. 2. When so folded and positioned, top and bottom flaps 180A, 180B may be oriented generally parallel to one another and generally perpendicular to both center section 120 and center section 130. Top flap 180A may also lie generally within the same plane as top flap 160A, and bottom flap 180B may lie generally within the same plane as bottom flap 160B.

Center section 140 may then be folded along crease 210I so that center section 140 is positioned against or adjacent to a surface of the item 101 opposite center section 120. When so folded, center section 140 may be oriented generally perpendicular to center section 130, thereby forming a third sidewall 270 of foldable box 300.

Next, center section 150 may be folded along crease 210L so that center section 150 is positioned against or adjacent to the same surface of the item 101 as center section 110. When so folded, center section 150 may be oriented generally perpendicular to center section 140. Additionally, when center section 150 is so folded, center section 150 may lie generally in the same plane as or generally parallel to center section 110. Accordingly, center sections 110, 150 cooperate to form a fourth sidewall 280 of foldable box 300.

As seen in FIG. 3, when center sections 110, 150 are folded to form sidewall 280, center sections 110, 150 form at least a portion of a seam 290. Seam 290 may be formed by the edges of center sections 110, 150 that touch, abut, or are adjacent to one another. Additionally, seam 290 may also be formed at least in part by the edges of top of bottom flaps 160A, 160B, 200A, 200B that touch, abut, or are adjacent to one another. In some embodiments, center sections 110, 150 may at least partially overlap one another. In such a case, seam 290 may be formed on the outside of box 300 at the exposed edge of either center section 110 or center section 150.

After sidewall 280 is formed, top and bottom flaps 200A, 200B are folded along creases 210M, 210N, respectively, so as to be positioned against or adjacent to the same opposing surfaces of the item 101 as top and bottom flaps 160A, 160B, respectively. When so folded, top and bottom flaps 200A, 200B may be oriented generally parallel to one another and generally perpendicular to both center section 150 and center section 140. Additionally, top flap 200A may also lie generally within the same plane as top flap 160A, and bottom flap 200B may lie generally within the same plane as bottom flap 160B.

Top flap 190A may then be folded along crease 210J and bottom flap 190B may be folded along crease 210K to at least partially cover top flaps 160A, 180A and bottom flaps 160B, 180B, respectively, and portions of the item 101. The folded top flap 190A may form a portion of top surface 230, and the folded bottom flap 190B may form a portion of bottom surface 240.

As seen in FIG. 3, when top flaps 170A, 190A are folded to form top surface 230, top flaps 170A, 190A form a seam 310. Seam 310 may be formed by the edges of top flaps 170A, 190A that touch, abut, or are adjacent to one another. Similarly, when bottom flaps 170B, 190B are folded to form bottom surface 240, bottom flaps 170B, 190B form a seam 320. Seam 320 may be formed by the edges of bottom flaps 170B, 190B that touch, abut, or are adjacent to one another.

In some embodiments, top flaps 170A, 190A may at least partially overlap one another and bottom flaps 170B, 190B may at least partially overlap one another. In such a case, seams 310, 320 may be formed on the outside of box 300 at the exposed edges of either top flap 170A or top flap 190A and either bottom flap 170B or bottom flap 190B.

In any case, top and bottom seams 310, 320 may be substantially aligned with one another. In other words, as shown in FIG. 3, top seam 310 may be positioned vertically above bottom seam 320. Aligning top and bottom seams 310, 320 may facilitate secure closure of box 300 with a single piece of tape, as discussed below. Tape used in connection with closing a box formed from template 100 may be any suitable type of adhesive tape, including a pressure sensitive tape or a moisture activated tape that is applied by a handheld tape dispenser or an automated or semi-automated taping machine.

Seam 290, formed by center sections 110, 150, may be generally aligned with seams 310, 320, or may be offset from seams 310, 320. For instance, when lengths $S_1$ and $S_5$ (e.g., the lengths of center sections 110, 150) are generally equal to one another, seam 290 may be generally aligned with seams 310, 320 (similar to seam 290 shown in FIG. 10). However, when lengths $S_1$ and $S_5$ are different from one another, seam 290 may be horizontally offset from seams 310, 320. For instance, as shown in FIG. 3, the length of center section 110 is longer than center section 150. As a result, seam 290 is positioned closer to crease 210L than crease 210C and is offset from seams 310, 320.

The offset between seam 290 and seams 310, 320 may be generally equal to the difference between lengths $S_1$ and $S_5$. In some embodiments, the offset is small enough to allow a single piece of tape 330 to seal seams 290, 310, 320. For instance, as shown in FIG. 3, a single piece of tape 330 may extend around all or substantially all of box 300 securely close box 300. More specifically, a single piece of tape 330 may be applied across seam 310 to hold top flaps 170A, 190A together, across seam 290 to hold center sections 110, 150 in place, and across seam 320 to hold bottom flaps 170B, 190B together.

In some embodiments, having seam 290 offset from seams 310, 320 may provide structural integrity to box 300. When seam 290 is offset from seams 310, 320, top and bottom flaps 190A, 190B extend across seam 290, which may help prevent box 300 from twisting apart.

When box 300 has been fully constructed from box template 100, as illustrated in FIG. 3, box 300 has a width $W_B$ that is generally equal to the length $S_3$ and, in the case where the sum of lengths $S_1$ and $S_5$ equal length $S_3$, the sum of lengths $S_1$ and $S_5$. Box 300 also has a length $L_B$ that is generally equal to the lengths $S_2$ and $S_4$ of respective segments 2, 4. Also, box 300 has a height $H_B$ that is generally equal to the length $W_{CS}$.

With continuing attention to FIG. 1, attention is now directed to FIGS. 4-13, which illustrate other exemplary methods for constructing a box using box template 100. As with the method discussed in connection with FIGS. 2 and 3, the following methods can be employed to construct a box having either aligned or offset seams.

The presently illustrated methods start with creating a "manufacturer's joint." A manufacturer's joint is where opposing ends of the box template are attached to one another so that the template can be arranged in a generally rectangular shaped tube. As noted above, this is typically done by gluing a glue tab that extends from one end of the template to a sidewall section on the opposite end of the template. Using a glue tab to attach opposing ends of the template together in this manner results in the manufacturer's joint being located in the corner of the resulting box. In contrast, the box template described herein allows for the creation of a manufacturer's joint that is offset from the corners of the resulting box, regarding of the method used to construct the box with the disclosed template.

Figure 4:
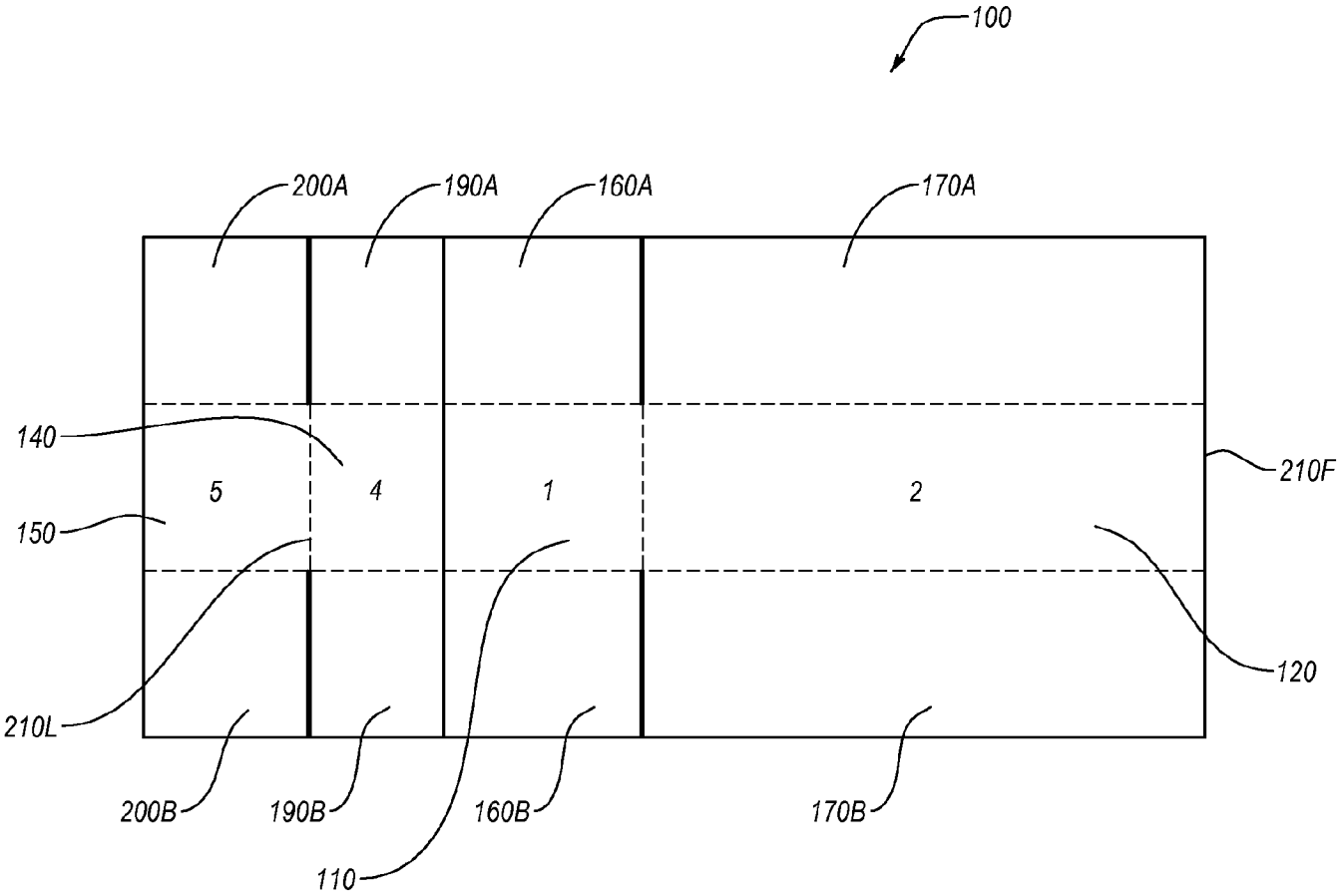
FIGS. 4-9 illustrate another exemplary method for constructing a box using the foldable box template of FIG. 1.
Figure 5:
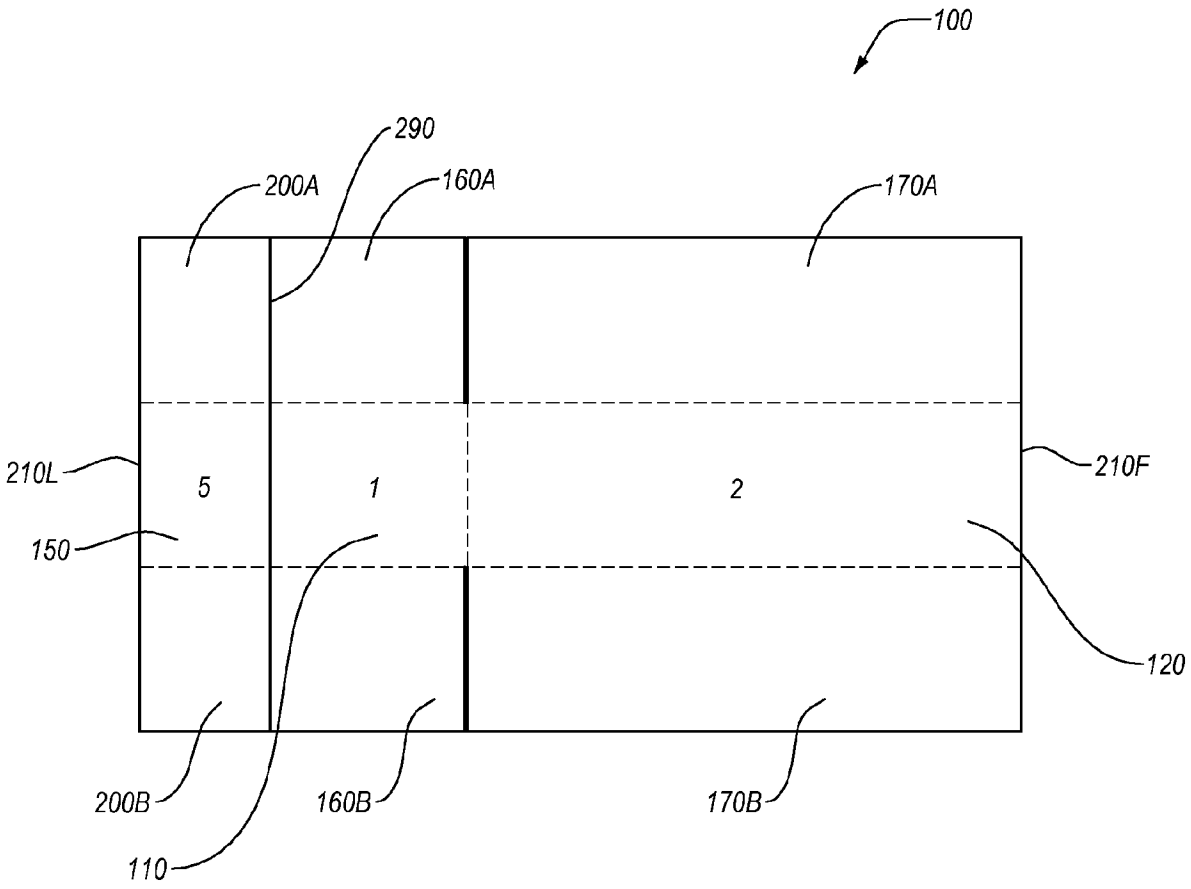
Figure 6:
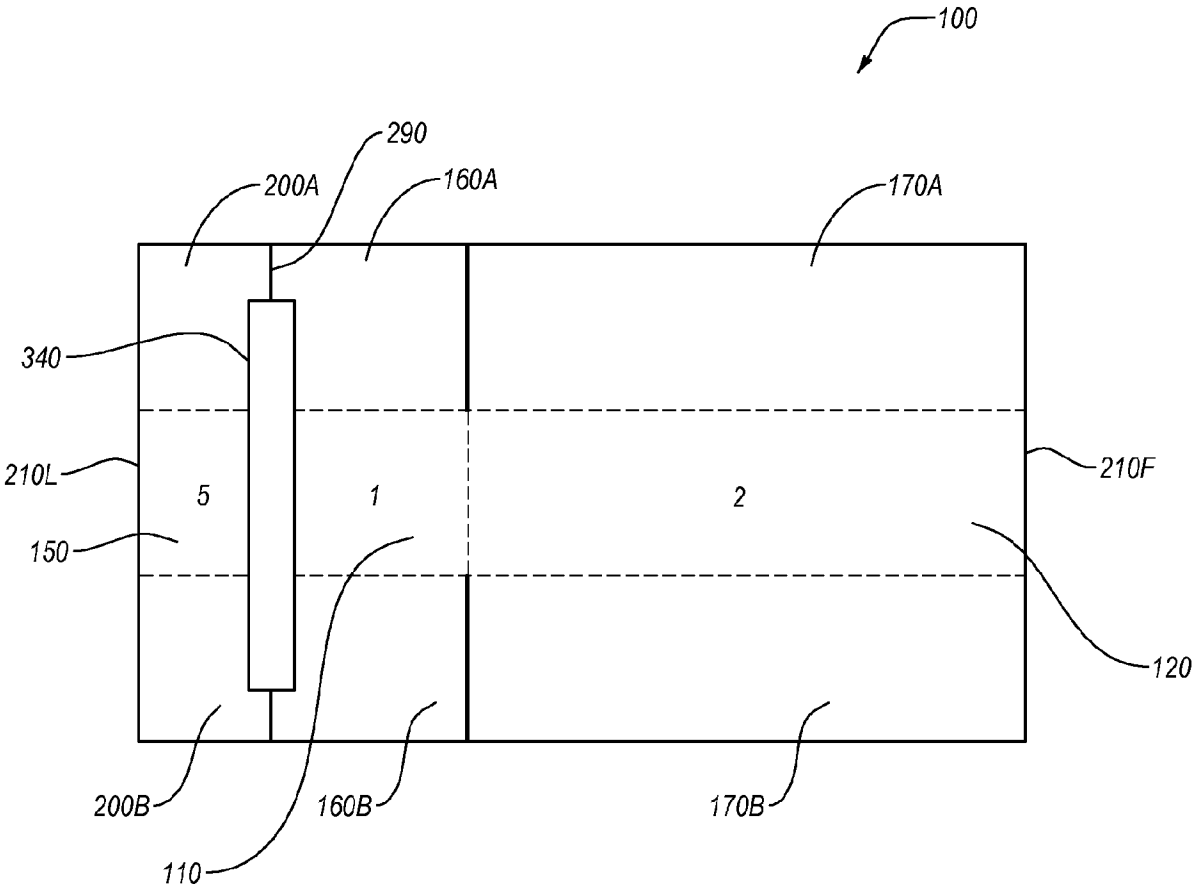

The creation of the manufacturer's joint according to one exemplary method is illustrated in FIGS. 4-6. As shown in FIG. 4, box template 100 is folded along crease 210F between segments 2, 3 so that segments 1, 2 lay on top of segment 3 and part of segment 4. FIG. 4 also shows that segment 5 and part of segment 4 remain uncovered.

The next step in creating the manufacturer's joint is shown in FIG. 5. Specifically, segment 5 is folded along crease 210L between segments 4, 5. When segment 5 is so folded, segment 5 lays on top of segment 4. Additionally, the free ends of template 100 are positioned adjacent to or abut one another, thereby creating seam 290.

Once seam 290 is created, segments 1, 5 may be secured together. For instance, as shown in FIG. 6, a piece of tape 340 may be applied across all or a portion of seam 290. By way of non-limiting example, tape 340 may be applied across a portion of seam 290 so that tape 340 is only applied to center sections 110, 150. Alternatively, as shown in FIG. 6, tape 340 may extend across seam 290 so that tape 340 is applied across center sections 110, 150 and across at least portions of top flaps 160A, 200A and bottom flaps 160B, 200B.

Notably, allowing tape 340 to be applied across center sections 110, 150 and across at least portions of top flaps 160A, 200A and bottom flaps 160B, 200B simplifies the creation of the manufacturer's joint. With typical box templates that are glued together, care must be taken to only apply glue to the glue flap or to the area where the glue flap will be attached (i.e., the opposing center section between the top and bottom flaps). In contrast, box template 100 allows for tape 340 to be applied along all or a portion of seam 290. In other words, tape 340 may be applied only to center sections 110, 150, or to center sections 110, 150 and one or both sets of top flaps 160A, 200A and bottom flaps 160B, 200B. The specific locations where tape 340 starts and stops along seam 290 is not crucial so long as sufficient tape is applied to hold seam 290 together.

Figure 7:
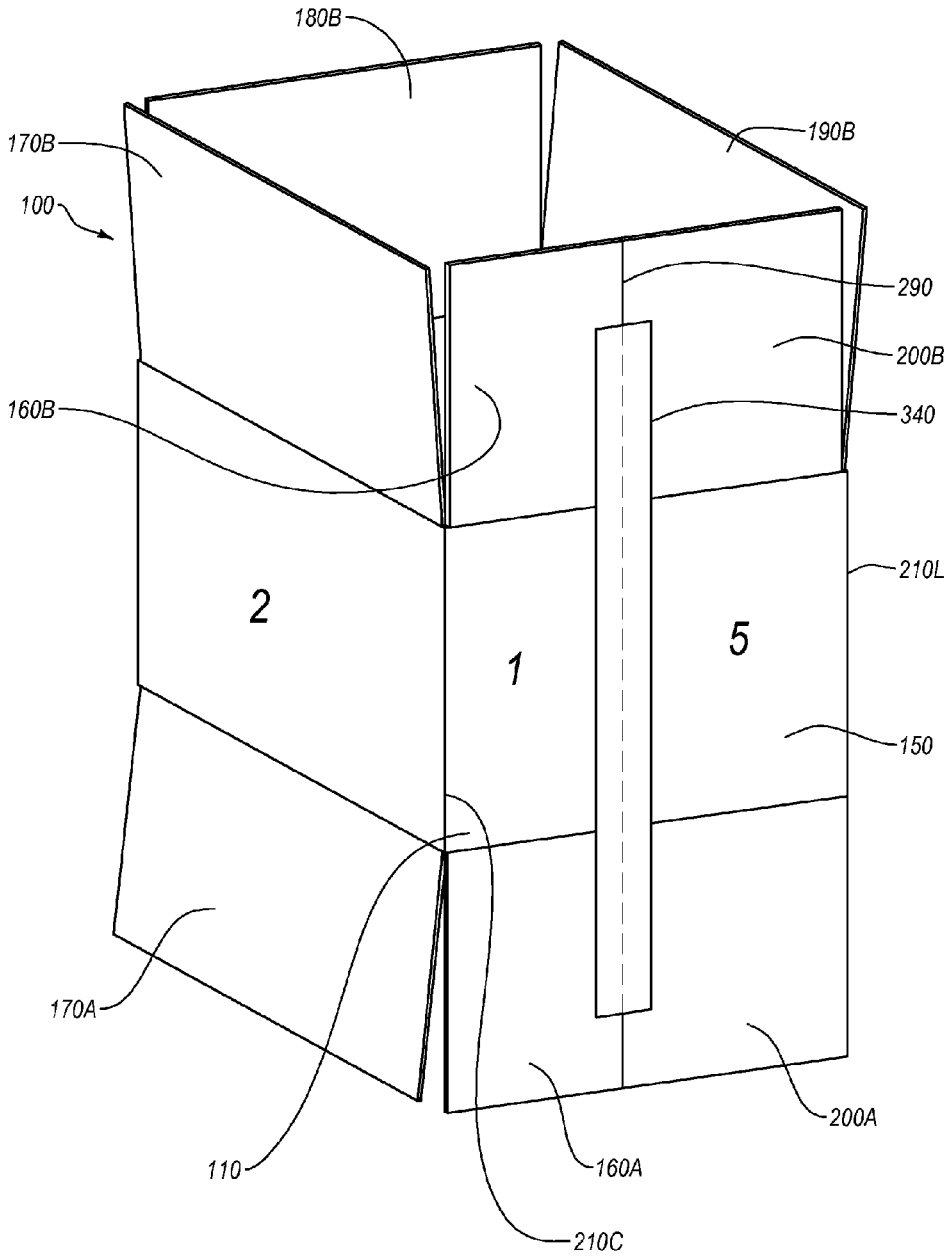
Figure 8:
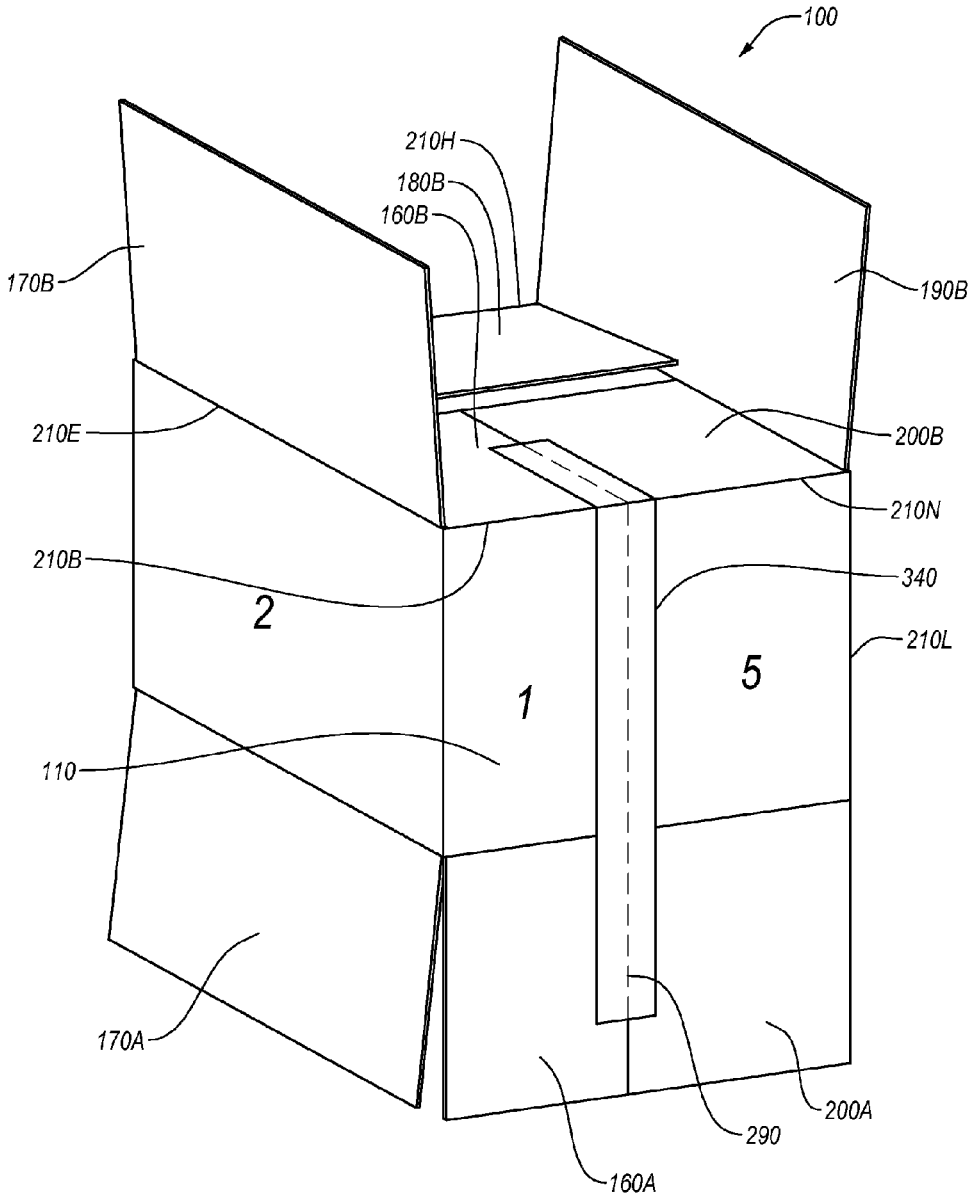
Figure 9:
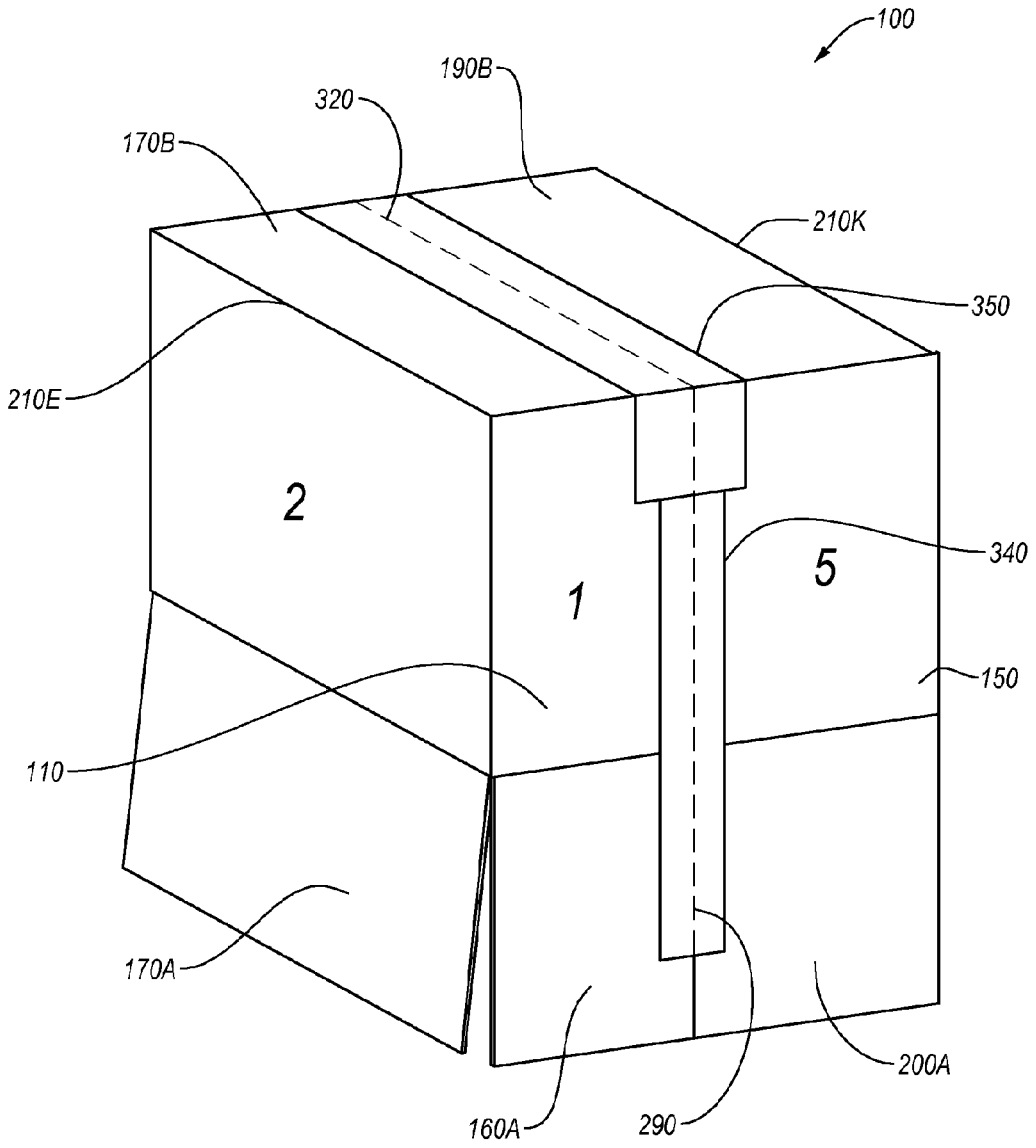

After creation of the manufacturer's joint, box template 100 may be erected into a box in a relatively conventional manner, as shown in FIGS. 7-10. To erect box template 100 into a box, box template 100 is arranged into a generally rectangular tube, as shown in FIG. 7. It is noted that box template 100 is shown in FIGS. 7-9 with bottom flaps 160B, 170B, 180B, 190B extending upwardly or positioned on top of box template 100. This is done to allow for the bottom flaps to be folded closed to create the bottom of a box. Once the bottom of the box is created, the box template may be inverted and filled and the top flaps may be folded closed and sealed to create the top of the box.

More specifically, as shown in FIG. 8, bottom flap 180B is folded toward the interior of the rectangular tube along crease 210H and bottom flaps 160B, 200B are likewise folded along creases 210B, 210N, respectively, toward the interior of the rectangular tube. When tape 340 extends across bottom flaps 160B, 200B as shown, bottom flaps 160B, 200B may fold together rather than having to be individually folded. In other words, folding one of flaps 160B or 200B will, due to tape 340, cause the other flap to fold as well. In addition, the extension of tape 340 from center sections 110, 150 and onto flaps 160B, 200B also increases the structural integrity of the resulting box.

With flaps 180B, 160B, 200B folded in, bottom flaps 170B, 190B are then folded toward the interior of template 100, as shown in FIG. 9. More specifically, bottom flap 170B is folded along crease 210E and bottom flap 190B is folded along crease 210K. When flaps 170B, 190B are so folded, the free ends of flaps 170B, 190B are positioned adjacent to or abut one another, thereby creating a bottom seam 320. A piece of tape 350 may then be applied across seam 320 to hold bottom flaps 170B, 190B in place. As shown in FIG. 9, tape 350 may also extend onto the side surfaces of the box formed by center sections 1, 5, 3. Tape 350 may also overlap tape 340 as shown.

Once the bottom of the box has been closed as shown in FIG. 9, the partially erected box may be inverted so that top flaps 160A, 170A, 180A, 190A, 200A extend upward. The item(s) to be packaged in the box may then be place therein and the top of the box may be closed. In closing the top of the box, the same process used to close the bottom of the box may be used. That is, top flaps 180A, 160A, 200A may be folded in, followed by top flaps 170A, 190A being folded in. Top flaps 170A, 190A may form a seam 310 similar to seam 320. A piece of tape 360 may be applied across seam 310 and, optionally, onto the side surfaces of the box formed by center sections 1, 5, 3. Like tape 350, tape 360 may also overlap tape 340 as shown.

Figure 10:
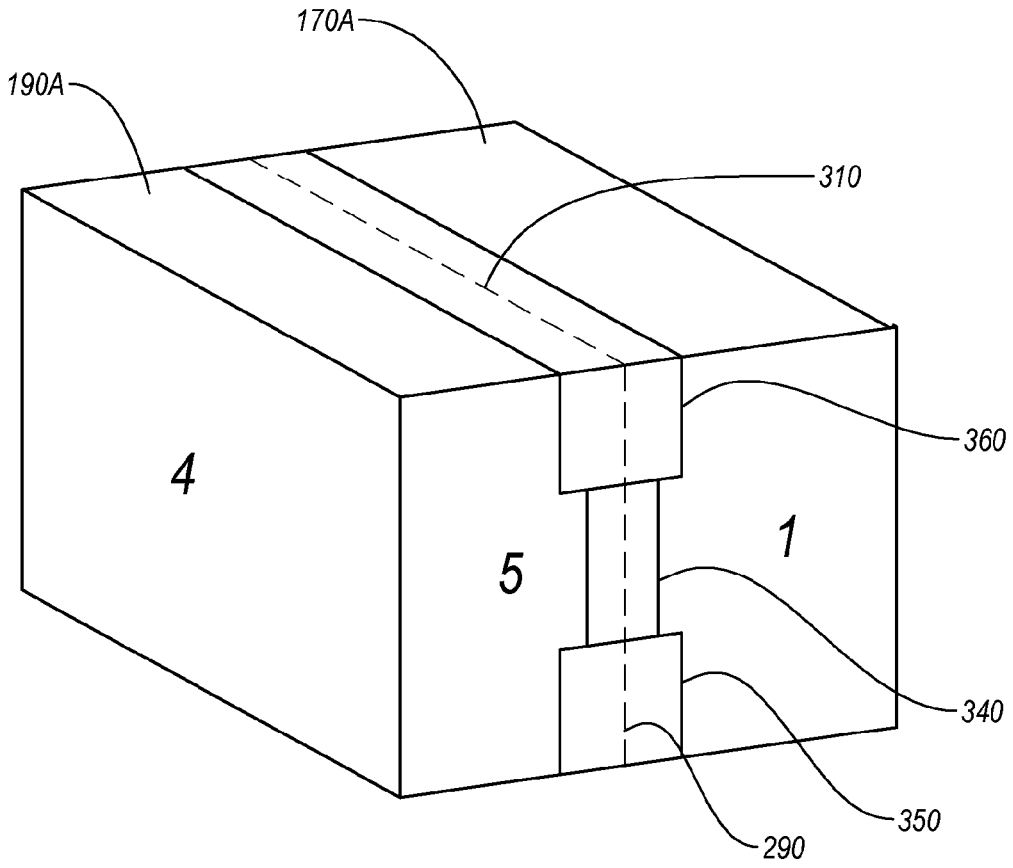
FIG. 10 illustrates a box constructed from the foldable box template of FIG. 1 using the method shown in FIG. 4-9.

As illustrated in FIGS. 9 and 10, seam 290 is generally aligned with top and bottom seams 310, 320. The alignment of these seams may be achieved by making each of the lengths $S_1$ and $S_5$ generally equal to about half the length $S_3$. As noted above, however, seam 290 may be offset from one or both of seams 310, 320. This can be achieved by making the lengths $S_1$ and $S_5$ different from one another.

Figure 11:
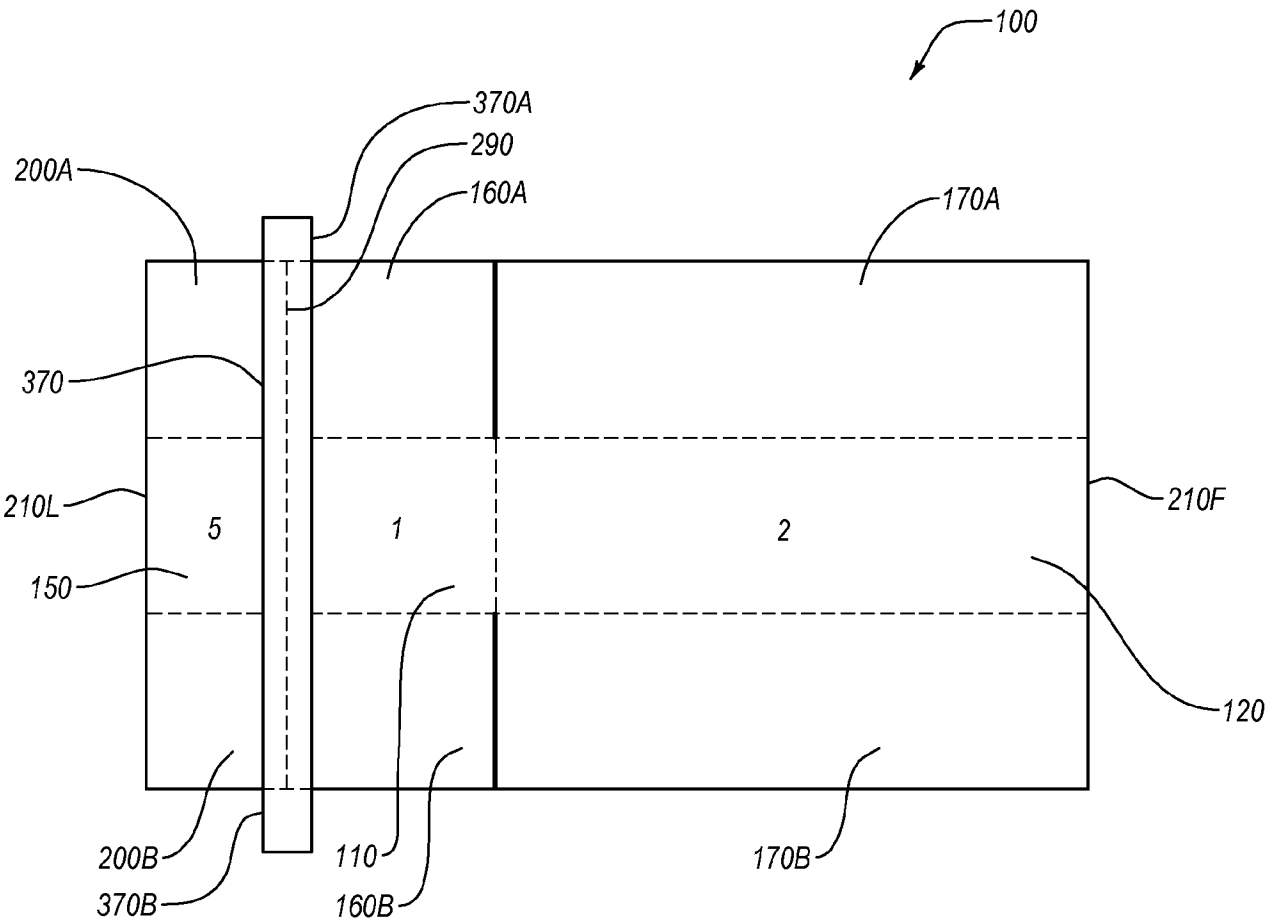
FIGS. 11-13 illustrate an exemplary method for creating a manufacturer's joint on a box template.
Figure 12:
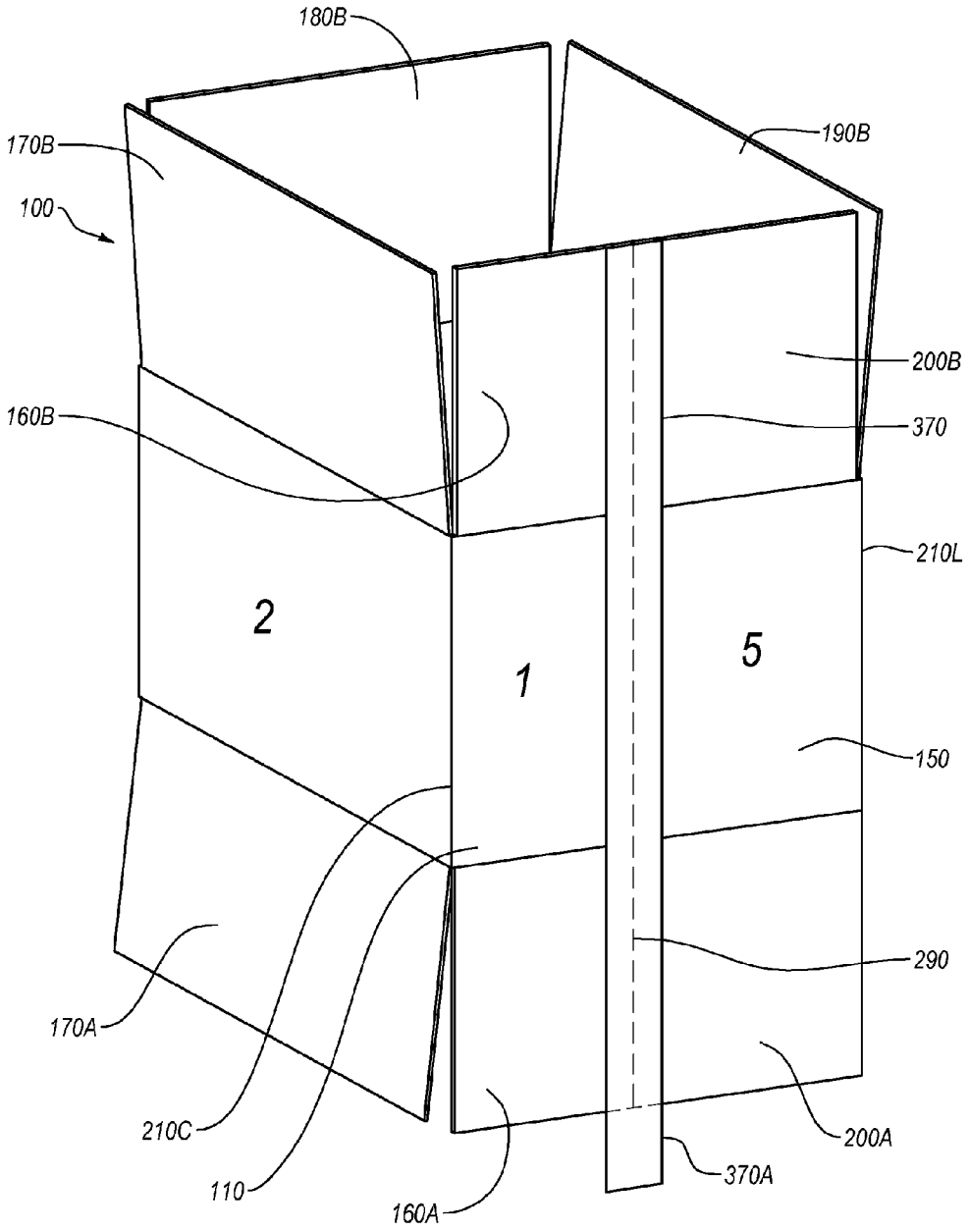
Figure 13:
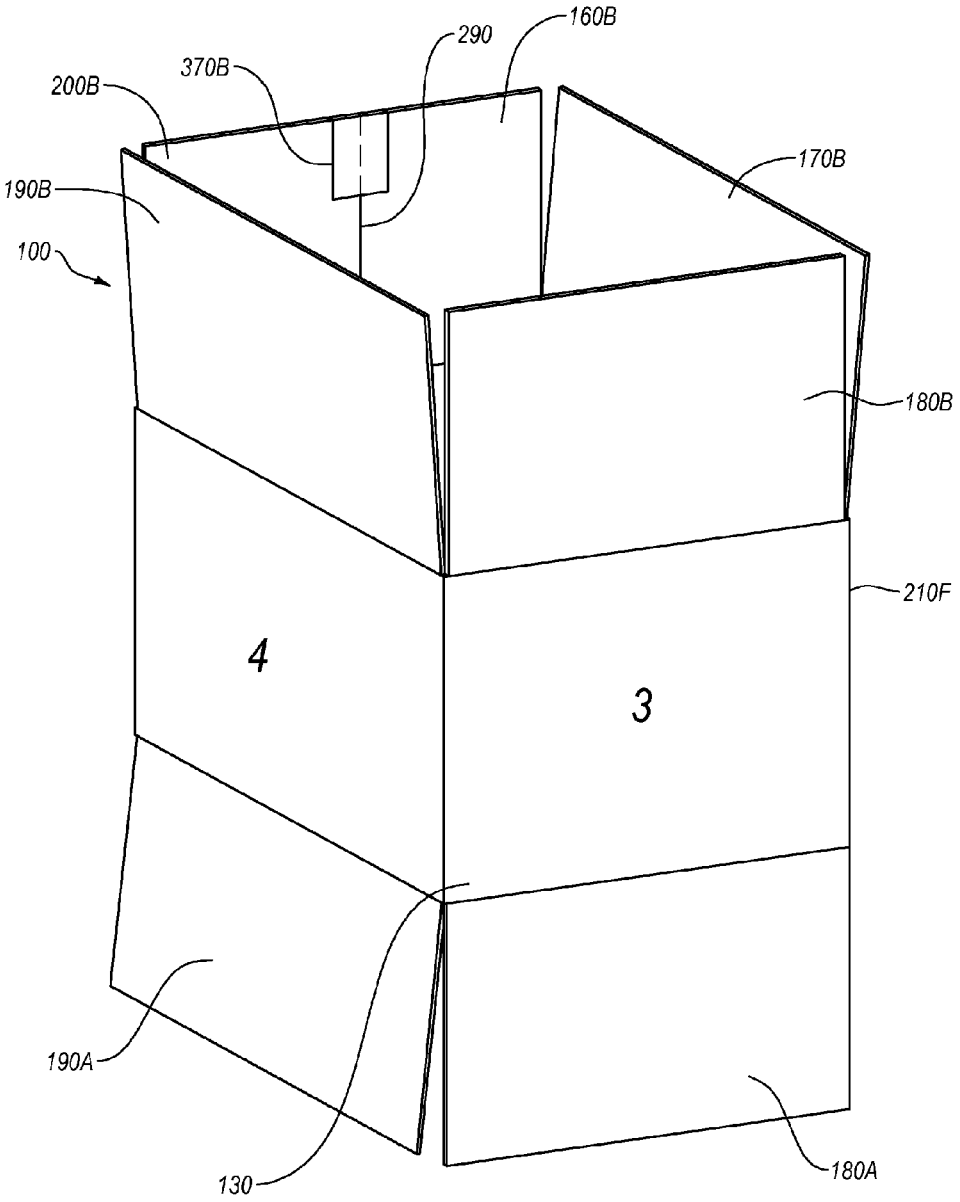
Figure 14:
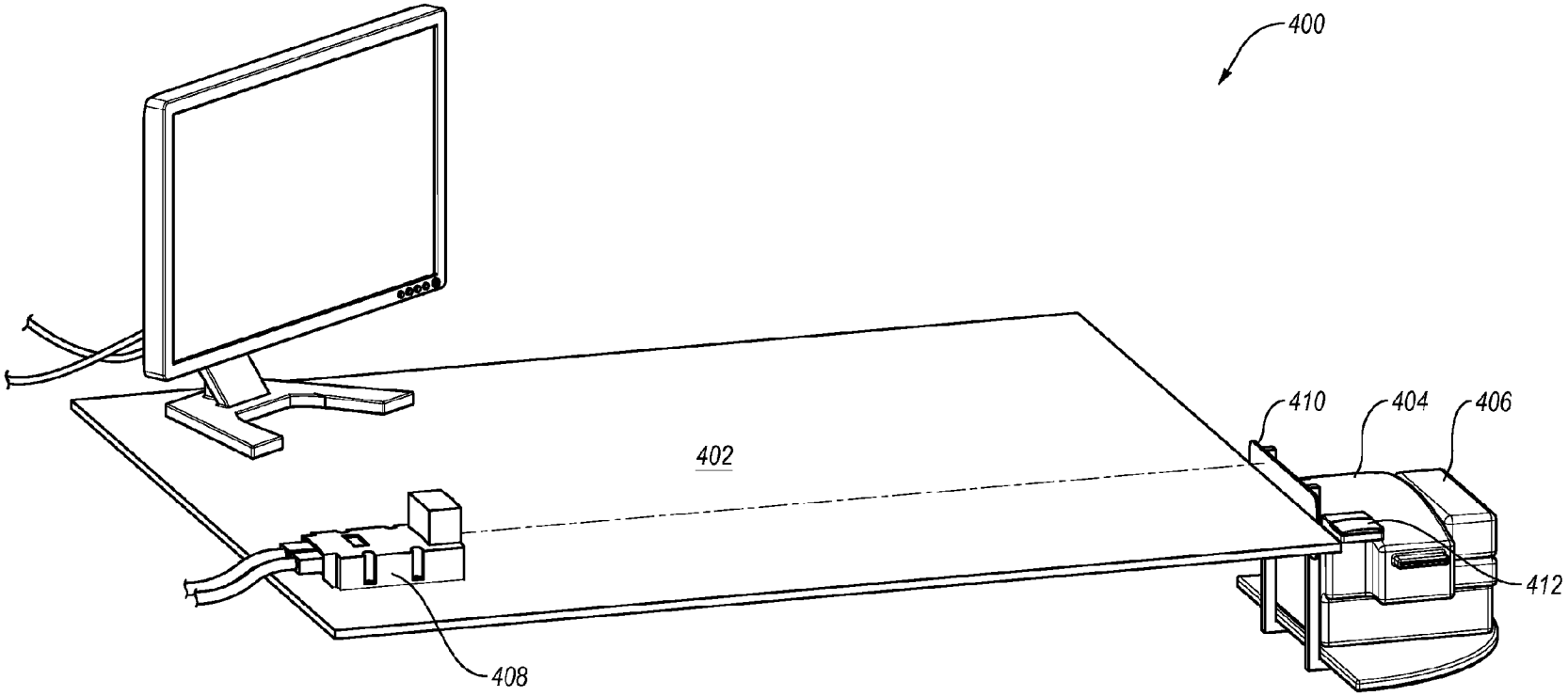
FIG. 14 illustrates an exemplary system for measuring tapable surfaces of a box template in order to produce appropriately sized pieces of tape for sealing the tapable surfaces of the box template.

The creation of the manufacturer's joint according to another exemplary method is partially illustrated in FIGS. 11-13. Prior to the steps shown in FIGS. 11-13, box template 100 is folded in the manner described in connection with FIGS. 4 and 5. That is, box template 100 is folded so that the opposing or free ends of template 100 are positioned adjacent to or abut one another, thereby creating seam 290.

After forming seam 290, segments 1, 5 are secured together. For instance, as shown in FIG. 11, a piece of tape 370 may be applied across seam 290 on an exterior surface of box template 100. In the illustrated example, tape 370 is applied across the entire length of seam 290 so that tape 370 secures the entire lengths of top flap 160A, center section 110, and bottom flap 160B to the entire lengths of top flap 200A, center section 150, and bottom flap 200B, respectively.

As shown in FIG. 11, when tape 370 is applied to box template 100, tape 370 may extend beyond the edges of box template 100. In other words, tape 370 may be longer than the width of the template $W_{template}$, such that the ends 370A, 370B of tape 370 may overhang the edges of box temple 100 when tape 370 is first applied thereto. As discussed below, the overhanging ends 370A, 370B of tape 370 may be used to further increase the strength or structural integrity of the manufacturer's joint.

After tape 370 has been applied across seam 290, box template 100 may be erected into a box in a manner similar or identical to the manner described above in connection with FIGS. 7-10. For instance, template 100 may first be arranged into a generally rectangular tube, as shown in FIG. 12. However, prior to folding and securing the top and bottom flaps to create the top and bottom of the box, the ends 370A, 370B of tape 370 may be secured to box template 100.

For example, while box template 100 is being arranged into a rectangular tube, or after box template 100 has been arranged into a rectangular tube, the overhanging ends 370A, 370B of tape 370 may be folded over the edges of box temple 100 and applied to the interior surface of box template 100. As shown in FIGS. 12 and 13, for instance, end 370B has been folded over an edge of box temple 100 and applied to the interior surfaces of bottom flaps 160B, 200B. End 370A can likewise be folded over an edge of box template 100 and be applied to the interior surfaces of top flaps 160A, 200A.

As can be seen in FIGS. 12 and 13, when end 370B is folded over the edge of box template 100 and applied to the interior surface thereof, tape 370 covers seam 290 on the exterior of box template 100, the edge of box template 100 adjacent to where bottom flaps 160B, 200B meet, and a portion of seam 290 on the interior surface of box template 100. Although not illustrated, end 370A can also be folded over an edge of box template 100 and applied to the interior surface thereof so that tape 370 covers the edge of box template 100 where top flaps 160A, 200A meet and an interior portion of seam 290 created by top flaps 160A, 200A. In other words, tape 370 may extend from a first surface (e.g., the exterior surface of box template 100), over a first edge, and onto a second surface (e.g., the interior surface of box template 100) that is generally parallel to the first surface. Tape 370 may also extend from the first surface (e.g., the exterior surface of box template 100), over a second edge, and onto the second surface. As a result, a single piece of tape 370 may cover all or a substantial portion of seam 290 on the exterior or first surface of box template 100. Additionally, the single piece of tape 370 may also extend over the opposing edges of box template 100 so as to cover: (i) one or more portions of seam 290 on the interior or second surface of box template 100 and (ii) the edges of box template 100 where segments 1, 5 meet.

Such an arrangement provides various benefits. For instance, having tape 370 applied across seam 290 on both the interior and exterior surfaces of box template 100 helps maintain the relative positioning of attached flaps (e.g., the relative positioning of top flaps 160A, 200A and the relative positioning of bottom flaps 160B, 200B). This arrangement can also substantially prevent attached flaps from unintentionally overlapping or separating from one another. Furthermore, applying tape 370 to box template 100 so that it extends from an exterior surface, over the edges where seam 290 is formed, and onto an interior surface reduces the likelihood of failure for the manufacturer's joint (e.g., as a result of the tape tearing along seam 290 or separating from the both template 100).

With tape 370 so applied and the manufacturer's joint completed, the erection of box template 100 may proceed. Similar to the process described above in connection with FIGS. 7-10, bottom flaps 180B, 160B, 200B may be folded in after which bottom flaps 170B, 190B may be folded in to create the bottom of the box. Tape may then be applied to secure bottom flaps 170B, 190B together, as described above in connection with FIG. 9. The partially erected box may then be inverted, filled and closed. To close the top of the box, top flaps 180A, 160A, 200A may be folded in, followed by top flaps 170A, 190A being folded in. Tape may then be applied to secure top flaps 170A, 190A together.

Attention is now directed to FIGS. 14-17, which illustrate one exemplary system 400 and a method for measuring appropriate lengths of tape (e.g., pieces of tape 340, 350, 360, 370) for sealing one or more of seams 290, 310, 320 described above. According to the illustrated embodiment, system 400 includes a support structure 402 (e.g., table, counter, bench) on which at least a portion of a box template may be positioned during a tape measurement process.

System 400 also includes a taping apparatus 404 that is configured to dispense an adhesive tape for taping a box (e.g., seams 290, 310, 320). In the illustrated embodiment, taping apparatus 404 is a water activated tape dispenser, but may be any type of tape dispenser. As shown, taping apparatus 404 is positioned to one side of and at about the same level as support structure 402. In other embodiments, taping apparatus 404 may be positioned on, above, or below support structure 402.

Water activated tape dispenser 404 includes a water reservoir 406 and a roll or other supply of a water-activated adhesive strip (not shown). For example, water activated tape dispenser 404 is configured to dispense a selected length of a moistened adhesive strip when called upon to do so. The selected length of the moistened adhesive strip can then be applied to one or more surfaces of a box to seal, for example, the manufacturer's joint, either end, or both ends of the box. In the illustrated embodiment, In one embodiment, taping apparatus 404 may be operably coupled to a means for measuring a length of at least one tapable surface on the box. The measuring means can, for example, instruct taping apparatus 404 to dispense a length of tape sized for sealing a selected surface of the box. Suitable examples of means for measuring the length of at least one tapable surface include, but are not limited to, an optical sensor, an ultrasonic sensor, pressure sensor, an automated box cutting apparatus, a camera, and combinations thereof.

In the illustrated example, the means for measuring the length of the at least one tapable surface of the box includes an ultrasonic sensor 408 and a plate 410. In the illustrated example, ultrasonic sensor 408 and reference plate 410 are relatively situated and ultrasonic sensor 408 is calibrated such that ultrasonic sensor 408 measures the length of the box portion that is to be taped, as will be described in greater detail below. Ultrasonic sensor 408 then directs taping apparatus 404 to dispense a piece of tape having the measured length. Ultrasonic sensor 408 may automatically direct taping apparatus 404 to dispense the tape upon measurement of the box, or ultrasonic sensor 408 may direct taping apparatus 404 to dispense the tape when an operator depresses a switch (e.g., switch 412).

In the illustrated example, plate 410 is positioned along an edge of support structure 402 and extends vertically higher than a top surface of support structure 402. Plate 410 acts as a reference point for ultrasonic sensor 408. If an object, such as a box template, is placed against plate 410, ultrasonic sensor 408 will direct taping apparatus 404 to dispense a length of tape that is sized as a function of the distance between a portion of the box template and plate 410. Ultrasonic sensor 408 can then direct taping apparatus 404 to dispense a length of tape that is approximately equal to the determined distance.

Figure 15:
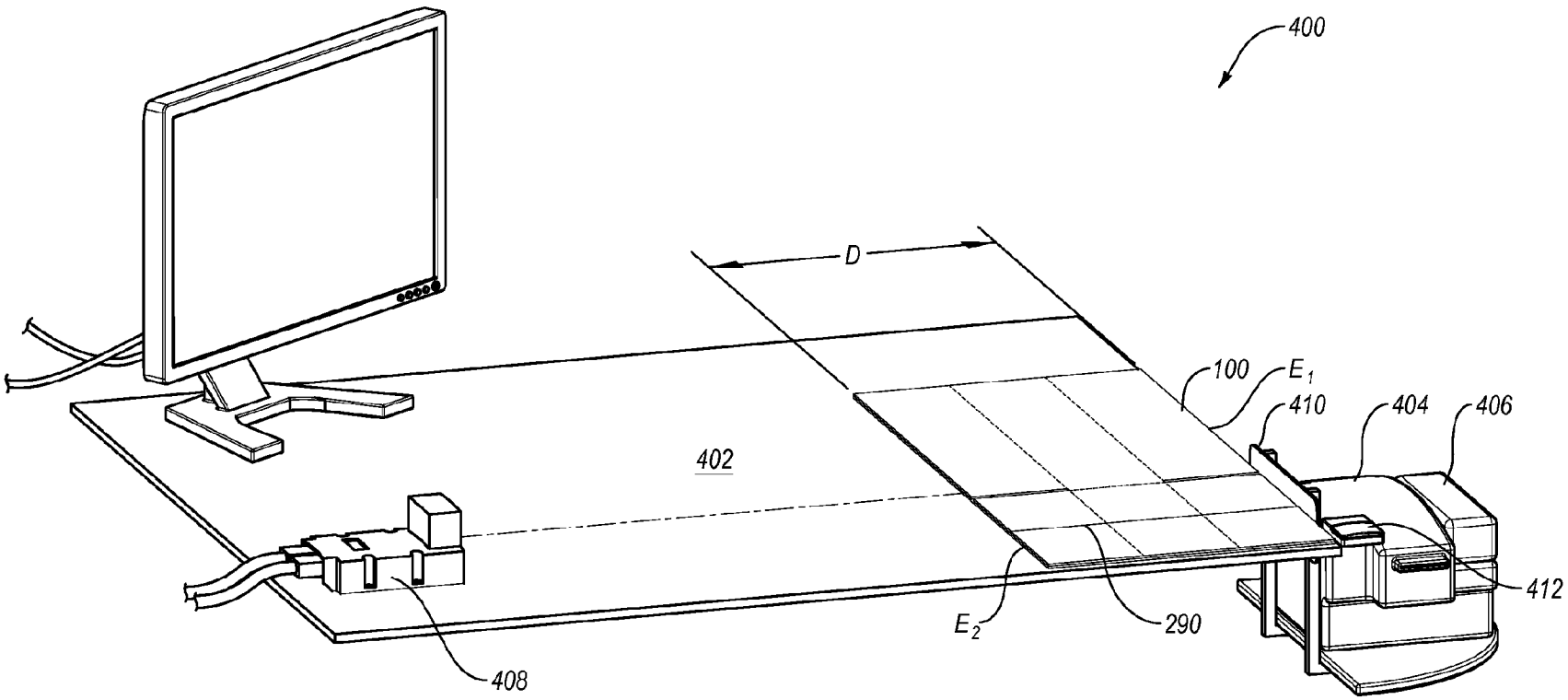
FIGS. 15-17 illustrate an exemplary method for constructing a box using the system of FIG. 14.
Figure 16:
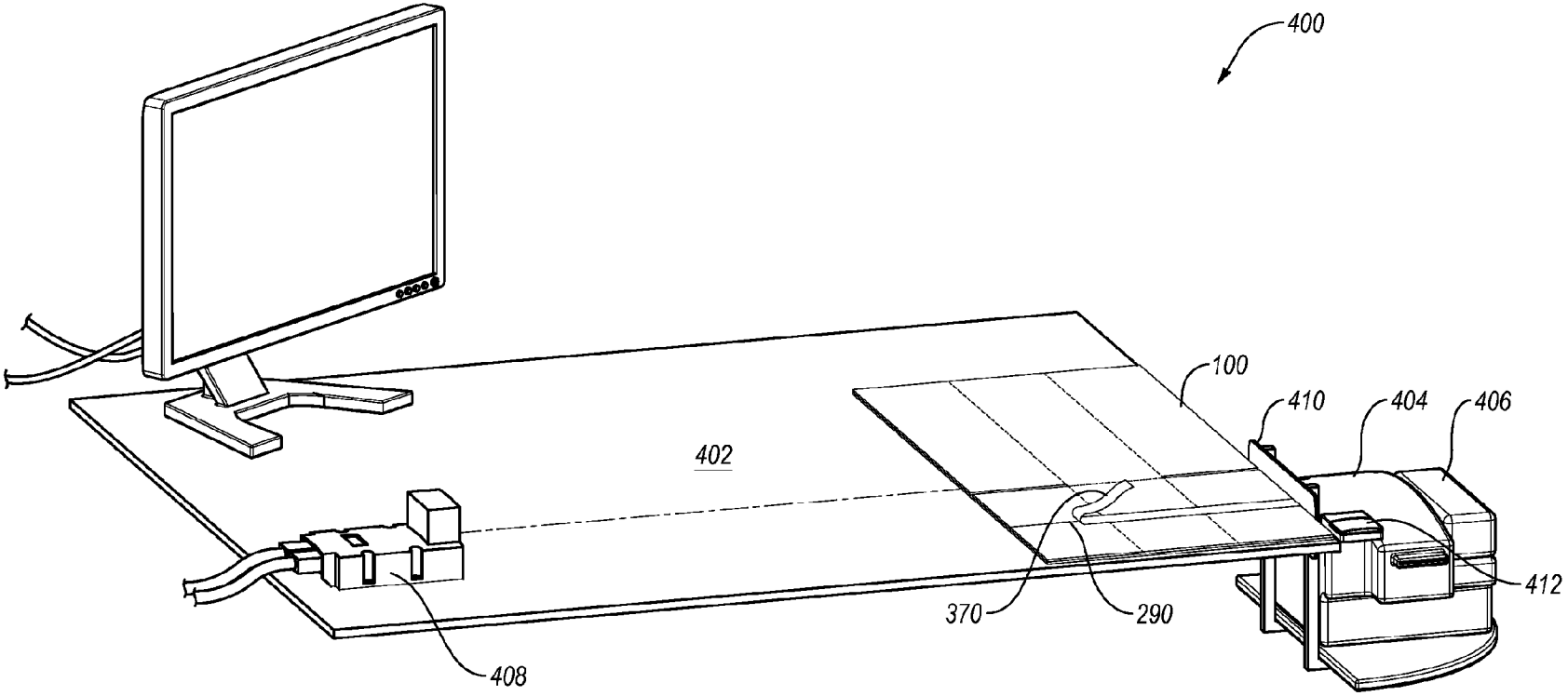
Figure 17:
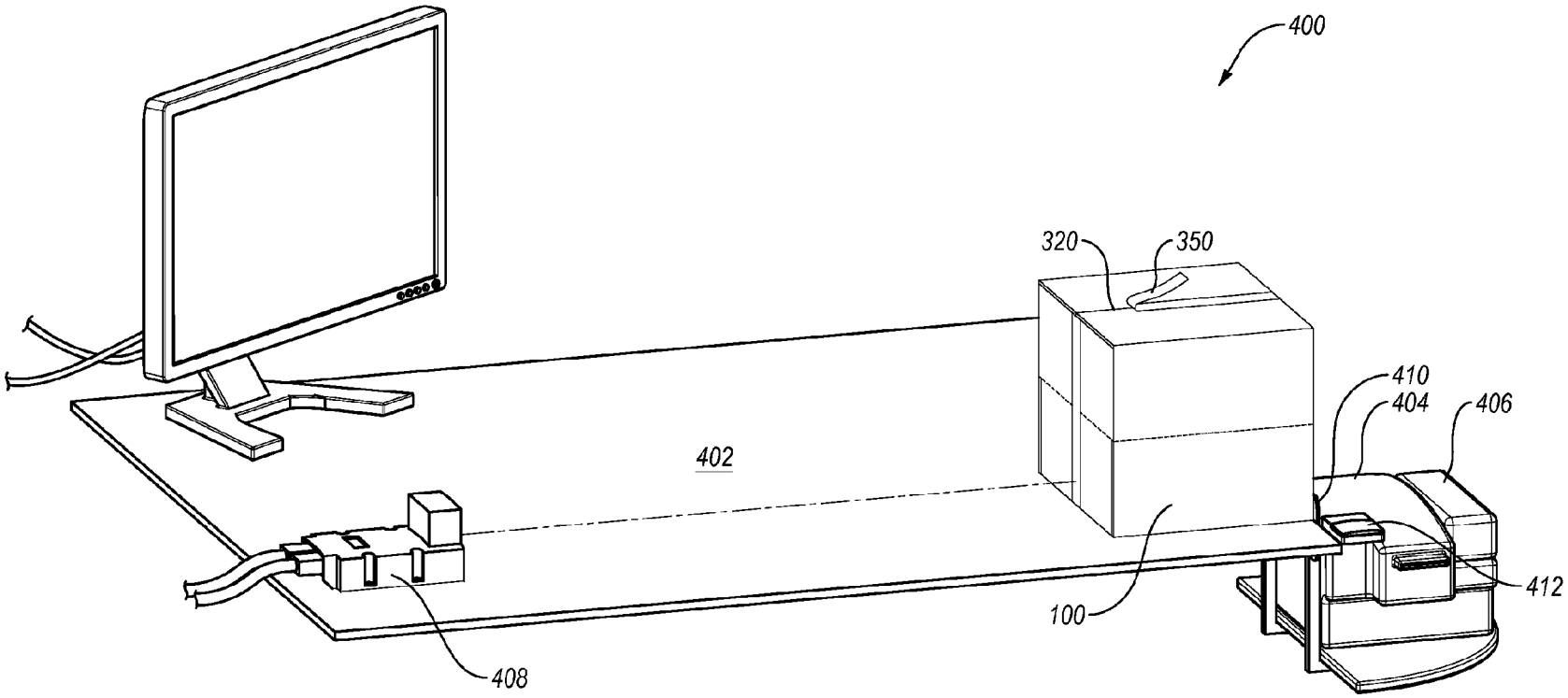

FIGS. 15-17 illustrate in more detail the use of system 400 and the steps of measuring appropriate lengths of tape for sealing one or more of seams of a box. As shown in FIG. 15, a box blank 100, folded as described above in connection with FIG. 5 (e.g., to form seam 290), is positioned on support structure 402 such that a first edge $E_1$ of box template 100 is positioned against plate 410. As can be seen, a second edge $E_2$ is positioned between plate 410 and ultrasonic sensor 408.

With box template 100 positioned as shown in FIG. 15, ultrasonic sensor 408 can measure the length of seam 290. More specifically, ultrasonic sensor 408 can determine the position of second edge $E_2$ and calculate the distance between second edge $E_2$ and plate 410. Depending on the sensor used, second edge $E_2$ may not be directly detectable by the sensor. In such a case, an operator may position his or her hand or another object in alignment with second edge $E_2$ and ultrasonic sensor 408 may detect the position of the operator's hand or the other object, and thus the position of second edge $E_2$. The distance D between second edge $E_2$ and plate 410/first edge $E_1$ as calculated by ultrasonic sensor 408 will be substantially equal to the length of seam 290. As such, ultrasonic sensor 408 can direct taping apparatus 404 to measure a length of tape having a length sized in proportion to the distance D between first edge $E_1$ and second edge $E_2$ such that a piece of tape is dispensed having an appropriate size (i.e., not too long and not too short) for sealing seam 290.

As discussed elsewhere herein, the length of the tape may be substantially equal to, shorter than, or longer than that actual length of seam 290. Accordingly, after calculating the distance D (i.e., the length of seam 290), ultrasonic sensor 408 may direct taping apparatus 404 to measure a length of tape that is substantially equal to the distance D. Alternatively, after calculating the distance D (i.e., the length of seam 290), ultrasonic sensor 408 may direct taping apparatus 404 to measure a length of tape that is shorter than distance D, such as piece of tape 340 described above. Similarly, after calculating the distance D (i.e., the length of seam 290), ultrasonic sensor 408 may direct taping apparatus 404 to measure a length of tape that is longer than the distance D, such as piece of tape 370 described above.

In instances where ultrasonic sensor 408 directs taping apparatus 404 to dispense a piece of tape that is longer or shorter than seam 290, the difference between the tape length and the length of seam 290 may be a fixed length or a relative length. By way of non-limiting example, ultrasonic sensor 408 may direct taping apparatus 404 to dispense a piece of tape that is six inches longer than seam 290. The extra length of the piece of tape may be folded on to the interior surface of the folded box template, as described above in connection with FIGS. 11-13. Likewise, ultrasonic sensor 408 may direct taping apparatus 404 to dispense a piece of tape that is three inches shorter than seam 290 such that the piece of tape covers most, but not all, of seam 290, similar to piece of tape 340 described above. Still further, ultrasonic sensor 408 may direct taping apparatus 404 to dispense a piece of tape that is a certain percentage (e.g., 80%, 90%, 110%, 120%) of the length of seam 290. Regardless of whether the tape is equal to, shorter than, or longer than the length of seam 290, the measured piece of tape is dispensed by taping apparatus 404 and applied to seam 290, as shown in FIG. 16.

Because system 400 measures the distance between second edge $E_2$ and plate 410/first edge $E_1$, system 400 can be used to measure the length of a seam 290 having a variety of sizes without having to recalibrate system 400. That is, for example, system 400 can be used to assemble and seal a variety of custom-made boxes for packaging a variety of goods without having to recalibrate system 400. Moreover, because system 400 assures that an appropriately sized piece of tape is dispensed regardless of the size of the box template, system 400 is easier to use and less cumbersome than other semi-automated or manual tape dispensing systems (e.g., a tape gun).

Referring now to FIG. 17, seam 290 of box template 100 has been sealed and box template 100 has been partially erected for sealing a first end. In the illustrated example, box template 100 has been placed on an end and aligned with plate 410 so that seam 320 extends at least part of the way between plate 410 and ultrasonic sensor 408. With box template 100 so aligned and positioned, switch 412 may be activated to cause ultrasonic sensor 408 to measure the length of seam 320. Ultrasonic sensor 408 may then direct taping apparatus 404 to measure a length of tape having a length sized in proportion to the length of seam 320. The length of the tape may be substantially equal to, shorter than, or longer than that actual length of seam 320. For instance, as discussed elsewhere herein, the length of the tape may be longer than seam 320 so that the ends of the tape may extend onto opposing sides of the box template. Accordingly, after calculating the length of seam 320, ultrasonic sensor 408 may direct taping apparatus 404 to measure a length of tape that is longer than seam 320. For instance, ultrasonic sensor 408 may direct taping apparatus 404 to measure a length of tape that is six inches longer than seam 320 so that the tape extends about three inches onto the opposing sides of the box.

Once the first end has been sealed, box template 100 can then be inverted and filled with a product via a second end. Once the box is filled, the second end can be folded closed and box 100 can be realigned with plate 410. The second end can then be sealed with another length of tape in a manner similar to that described for sealing the first end.

As noted above, an ultrasonic sensor is but one example of means for measuring a length of tapable surface on the box. In other embodiments, for instance, support structure 402 may have one or more sensors on an upper surface that are configured to detect the width $W_{template}$ of a box template. By way of non-limiting example, the upper surface of support structure 402 may include an array of pressure switches that are activated when a box template is positioned thereon. The pressure switches may determine, based upon the number of pressure switches that are activated, the width $W_{template}$ of the box template. Once the width of the box template is determined, the sensors may direct taping apparatus to measure a length of tape that is proportional to the width of the box template.

Regardless of the manner used to construct a box from box template 100, the resulting box includes a sidewall formed by two center sections from opposing ends of the box template. Additionally, the two center sections form a seam in the sidewall. The seam in the sidewall may be aligned with or offset from seams in the top and/or bottom of the box. In any case, the seam in the sidewall is offset from a corner of the box. Furthermore, the two center sections that form the seam in the sidewall may, optionally, not overlap one another. As a result, the interior of the resulting box may have a more uniform shape since there is no glue tab on the inside of the box, and the outside of the box may have fewer edges that may be caught as the box is moved or that would interfere with labels placed on the box.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A foldable template for forming a box, comprising:

a first segment disposed at a first end of said template, the first segment having a length, a width, a single top flap, and a single bottom flap;

a second segment having a length, a width, a single top flap, and a single bottom flap;

a third segment having a length, a width, a single top flap, and a single bottom flap;

a fourth segment having a length, a width, a single top flap, and a single bottom flap; and a fifth segment disposed at a second end of said template opposite to said first segment, the fifth segment having a length, a width, a single top flap, and a single bottom flap, wherein the sum of the lengths of the first segment and the fifth segment is equal to the length of the third segment, and wherein the length of the first segment and the length of the fifth segment are unequal to one another, wherein each of the top flaps and each of the bottom flaps has a length that is substantially equal to the length of a corresponding segment, and wherein each of the top flaps and each of bottom flaps is continuous and uninterrupted by notches or slots throughout the length and width thereof.

2. The foldable template of claim 1, wherein each segment has a center section, wherein the top and bottom flaps extend from opposing sides of the center sections.

3. The foldable template of claim 2, wherein, when the foldable template is formed into a box, (i) the top flap from the second segment and the top flap from the fourth segment cooperate to form a top seam that extends between two opposing sidewalls formed by the first segment, third segment, and fifth segment, and (ii) terminal edges of the center sections of the first segment and the fifth segment cooperate to form a sidewall seam on one of the two opposing sidewalls, the top seam and the sidewall seam being oriented in parallel planes.

4. The foldable template of claim 1, wherein the second segment is disposed between the first segment and the third segment.

5. The foldable template of claim 1, wherein the third segment is disposed between the second segment and the fourth segment.

6. The foldable template of claim 1, wherein the fourth segment is disposed between the third segment and the fifth segment.

7. The foldable template of claim 1, wherein the length of the second segment is substantially equal to the length of the fourth segment.

8. The foldable template of claim 1, wherein adjacent top flaps are separated by a cut and adjacent bottom flaps are separated by a cut.

9. The foldable template of claim 1, wherein any two adjacent segments are separated by a crease.

10. The foldable template of claim 1, wherein the length of the fifth segment is greater than the length of the first segment.

11. The foldable template of claim 1, wherein the foldable template is made of cardboard.

12. The foldable template of claim 1, wherein the length of the first segment is greater than the length of the fifth segment.

13. A foldable box, comprising:

a top surface formed by two opposing outer top flaps and up to three internal top flaps, wherein the two opposing outer top flaps form a top seam that extends between two opposing sides of the foldable box, wherein each of the internal top flaps has a constant length and a constant width, and wherein each of the internal top flaps is continuous and uninterrupted by notches or slots throughout the length and width thereof;

a bottom surface formed by two opposing outer bottom flaps and up to three internal bottom flaps, wherein the two opposing outer bottom flaps form a bottom seam that extends between the two opposing sides of the foldable box, wherein each of the internal bottom flaps has a constant length and a constant width, and wherein each of the internal bottom flaps is continuous and uninterrupted by notches or slots throughout the length and width thereof; and four sidewalls extending between the top and bottom surfaces, wherein one of the sidewalls forms one of the two opposing sides of the foldable box and is comprised of two segments that have respective terminal edges that abut one another to form a sidewall seam, wherein the sidewall seam is offset from a corner of said foldable box, and wherein the sidewall seam and at least one of the top seam and the bottom seam are disposed relative to one another in parallel planes.

14. The foldable box of claim 13, wherein the box comprises six internal flaps.

15. The foldable box of claim 13, wherein the sidewall seam is offset from the top seam and the bottom seam.

16. The foldable box of claim 13, further comprising a piece of tape that spans the sidewall seam to secure the two segments together with the respective terminal edges abutting one another, wherein the tape extends from an exterior surface of the foldable box and onto an interior surface of the foldable box.

17. A method of making a box, comprising:

providing a foldable box template having five segments each having a length, a width, a single top flap, and a single bottom flap, the top flaps and the bottom flaps each having a length that is substantially equal to the length of a corresponding segment, wherein each of the top flaps and each of the bottom flaps is continuous and uninterrupted by notches or slots throughout the length and width thereof, wherein two of the segments are disposed on opposite ends of the foldable box template, wherein the sum of the lengths of the two opposing end segments is equal to the length of the middle segment;

folding the foldable box template such that two flaps form a top surface and define a top seam that extends between two opposing sides of the box;

folding the foldable box template such that two other flaps form a bottom surface and define a bottom seam that extends between the two opposing sides of the box; and folding the foldable box template to form four sidewalls, wherein a first sidewall forms one of the two opposing sides of the box and is formed from the two opposing end segments, the two opposing end segments having terminal edges that abut one another to form a sidewall seam that is offset from a corner of the box, such that the sidewall seam and at least one of the top seam and the bottom seam are disposed relative to one another in parallel planes.

18. The method of claim 17, further comprising securing the two opposing end segments together to form the first sidewall, wherein securing the two opposing end segments together comprises:

applying a piece of adhesive tape across the sidewall seam on an exterior surface of the two opposing end segments;

folding a first end of the adhesive tape over a first edge and applying the adhesive tape onto an interior surface of the two opposing end segments; and folding a second end of the adhesive tape over a second edge and applying the adhesive tape onto the interior surface of the two opposing end segments.

19. The method of claim 17, wherein the sidewall seam formed by the two opposing end segments is offset from the top seam and the bottom seam.

20. The method of claim 17, wherein the sidewall seam formed by the two opposing end segments is aligned with the top seam and the bottom seam.

* * * * *